US006634916B2

(12) United States Patent
Kaneko et al.

(10) Patent No.: US 6,634,916 B2
(45) Date of Patent: Oct. 21, 2003

(54) MANUFACTURING METHOD AND MANUFACTURING APPARATUS OF IMAGE DISPLAYING APPARATUS

(75) Inventors: Tetsuya Kaneko, Yokohama (JP); Kohei Nakata, Tokyo (JP); Toshihiko Miyazaki, Hadano (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 09/813,138

(22) Filed: Mar. 21, 2001

(65) Prior Publication Data

US 2002/0004354 A1 Jan. 10, 2002

(30) Foreign Application Priority Data

Mar. 23, 2000 (JP) ..... 2000-081482
Sep. 29, 2000 (JP) ..... 2000-298028

(51) Int. Cl.[7] ..... H01J 9/26
(52) U.S. Cl. ..... 445/25
(58) Field of Search ..... 445/24, 25, 41, 445/59, 6, 40

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,591,061 A | * | 1/1997 | Ikeda et al. | 445/6 |
| 5,605,483 A | | 2/1997 | Takeda et al. | 445/2 |
| 5,749,763 A | | 5/1998 | Yoshioka et al. | 445/51 |
| 5,820,435 A | * | 10/1998 | Cooper et al. | 445/25 |
| 6,049,168 A | * | 4/2000 | Iosue et al. | 445/59 |
| 6,139,390 A | * | 10/2000 | Pothoven et al. | 445/41 |
| 6,254,449 B1 | * | 7/2001 | Nakanishi et al. | 445/25 |
| 6,309,272 B1 | * | 10/2001 | Nishimura | 445/25 |
| 6,419,539 B1 | * | 7/2002 | Tamura et al. | 445/6 |

FOREIGN PATENT DOCUMENTS

JP 11-135018 5/1999

OTHER PUBLICATIONS

W. P. Dyke et al., "Field Emission", Advances in Electronics and Electron Physics, vol. VIII, 1956, pp. 89–185.
H. Araki, et al., "Electroforming and Electron Emission of Carbon Thin Films", Journal of the Vacuum Soc. of Japan, vol. 2–6, No. 1, 1983, pp. 22–29 (with English Abstract on p. 22).
G. Dittmer, "Electrical Conduction and Electron Emission of Discontinuous Thin Films", Thin Solid Films, 9, 1972 pp. 317–328.
M. Elinson, et al., "The Emission of Hot Electrons and the Field Emissions of Electrons From Tin Oxide", Radio Engineering and Electronic Physics, Jul. 1965, pp. 1290–1298.
C.A. Mead, "Operation of Tunnel–Emission Devices," J. Applied Physics, vol. 32, No. 4, Apr. 1961, pp. 646–652.
C.A. Spindt et al., "Physical Properties of Thin Films of Thin–film Field Emission Cathodes with Molybdenum Cases," J. Applied Physics, vol. 47, No. 12, Dec. 1976, pp. 5248–5263.
M. Hartwell et al., "Strong Electron Emission From Patterned Tin–Indium Oxide Films", IEDM, 1975, pp. 519–521.

* cited by examiner

*Primary Examiner*—Renee Luebke
*Assistant Examiner*—Felix O. Figueroa
(74) *Attorney, Agent, or Firm*—Fitzpatrick, Cella, Harper & Scinto

(57) ABSTRACT

An image display appratus is manufactured by processing a panel member through a plurality of chambers including ones for a bake processing and a getter processing. The getter processng is performed at a temperature lower than a temperature of the panel member subjected to the bake processing, to prevent degrading of a getter film.

127 Claims, 2 Drawing Sheets

MANUFACTURING METHOD AND MANUFACTURING APPARATUS OF IMAGE DISPLAYING APPARATUS

BACKGROUND OF THE INVENTION

1. Field of the Invention

The present invention relates to a manufacturing method and a manufacturing apparatus of an image displaying apparatus, and more specifically an image displaying apparatus which is configured by sealing a face plate composing a display surface of a display panel to a rear plate which is disposed in opposition to the above described face plate with a gap interposed to compose a rear surface of the above described display panel.

2. Related Background Art

There are conventionally known electron-emitting devices which are roughly classified into thermal electron-emitting devices and cold cathode electron-emitting devices. The cold cathode electron-emitting devices include field emission type (hereinafter referred to as an FE type) electron-emitting devices, metal/insulating layer/metal type (hereinafter referred to as an MIM type) electron-emitting devices, surface conduction electron-emitting devices or the like.

Known as examples of the FE type electron-emitting devices are those which are disclosed by W. P. Dyke & W. W. Dolan, "Field Emission", Advance in Electron Physics, 8, 89 (1956), C. A. Spindt, "PHYSICAL Properties of thin-film field emission cathodes with molybdenum cones", J. Appl. Phys., 47, 5248 (1976) or the like.

Known as examples of the MIM type electron-emitting devices are those which are disclosed by C. A. Mead, "Operation of Tunnel-Emission Devices", J. Appl. Phys., 32, 646 (1961) or the like.

Known as examples of the surface conduction electron-emitting devices are those which are disclosed by M. I. Elinson, Radio Eng. Electron Phys., 10, 1290 (1965) or the like.

The surface conduction electron-emitting devices utilize a phenomenon that electrons are emitted when a current is supplied through a thin film having a small area formed on a substrate in a direction in parallel with a surface of the film. Reported as the surface conduction electron-emitting devices are those which use $SnO_2$ thin films contrived by Elinson et al., those which use Au thin films [G. Dittmer: "Thin Solid Films," 9, 317 (1972)], $In_2O_3/SnO_2$ thin film [M. Hartwell and C. G. Fonstad: "IEEE Trans. ED Conf.", 519 (1975)], those which use carbon films [Hisashi Araki, et al. "Vacuum", vol, 26, No. 1, p22 (1983)] or the like.

Used for manufacturing an image displaying apparatus which uses electron-emitting devices such as those described above are steps of preparing an electron source substrate (rear plate) on which these electron-emitting devices are arranged in a matrix and a phosphor substrate (face plate) mounted with a phosphor which emits rays when excited by an electron beam, disposing an envelope providing a vacuum seal structure and a spacer providing an atmospheric pressure resistant structure so that the electron-emitting devices and the phosphor are set inside, arranging the face plate and the rear plate in opposition to each other, sealing an interior using a material having a low melting point such as frit glass as a sealing agent, evacuating the interior to a vacuum through a preliminarily disposed vacuum exhaust pipe and sealing the vacuum exhaust pipe.

A manufacturing method which uses the above described conventional technique requires a remarkably long time for manufacturing a display panel and is not suited to manufacturing of a display panel which requires an internal vacuum degree of $10^{-6}$ Pa or more depressurized level.

This problem of the conventional technique is solved, for example, by a method disclosed by Japanese Patent Application Laid-Open No. 11-135018.

The method disclosed by the above-mentioned Japanese Patent Application Laid-Open No. 11-135018 uses only steps of positioning a face plate and a rear plate in a single vacuum chamber and sealing these two a bake processing, a getter processing, an electron beam clean processing or the like which are other steps required for manufacturing the above described display panel must also be carried out in vacuum chambers respectively and the face plate and the rear plate are moved among the vacuum chambers while introducing atmosphere, each of the vacuum chamber is evacuated to vacuum each time the face plate and the rear plate are conveyed into the vacuum chambers, and a long time is required for the manufacturing steps, whereby it is demanded to remarkably shorten the time for the manufacturing steps and simultaneously obtain a high vacuum degree of $10^{-6}$ Pa or more depressurized level at a final manufacturing step.

SUMMARY OF THE INVENTION

An object of the present invention is to shorten a time required for evacuation into a vacuum in manufacturing an image displaying apparatus and facilitate to obtain a higher vacuum degree, thereby enhancing a manufacturing efficiency.

The present invention provides a manufacturing method of an image displaying apparatus comprising steps of conveying panel member for composing a panel of an image forming apparatus consecutively into a plurality of processing chambers equipped with temperature control means respectively and set in depressurized conditions, subjecting to a plurality of processings the above described panel member while controlling temperature and forming a panel by sealing the above described panel members, characterized in that: the above described plurality of processing chambers include a bake processing chamber for bake processing of the above described panel member, a getter processing chamber into which the above described panel member is conveyed after the above described bake processing and in which a getter processing is performed on the above described panel members, and the above described getter processing is performed with the panel member in the above described getter processing chamber set at a temperature lower than a temperature of the panel members subjected to the bake processing in the above described bake processing chamber.

Furthermore, the present invention provides a manufacturing method of an image forming apparatus comprising steps of conveying panel member for composing a panel of an image forming apparatus consecutively into a plurality of processing chambers equipped with temperature control means respectively and set in depressurized conditions, subjecting to a plurality of processings the above described panel member while controlling temperature and forming a panel by sealing the above described panel member, characterized in that: the above described plurality of processing chambers include a bake processing chamber for bake processing of the above described panel members, a surface clean processing chamber into which the above described panel member is conveyed after the above described bake processing and in which a surface clean processing is performed on the above described panel member, and a getter processing chamber into which the above described panel member is conveyed after the above described surface clean processing and in which the getter processing is performed on the above described panel member, and the above described getter processing is performed with the above described panel member in the above described getter processing chamber set at a temperature lower than a temperature of the panel member subjected to the bake processing in the above described bake processing chamber.

Furthermore, the present invention provides a manufacturing method of an image displaying apparatus comprising steps of conveying panel member for composing a panel of an image displaying apparatus consecutively into a plurality of processing chambers equipped with temperature control means respectively and set in a depressurized conditions, subjecting to a plurality of processings the above described panel member while controlling temperature and forming a panel by sealing the above described panel members, characterized in that: the above described plurality of processing chambers include a bake processing chamber for bake processing of the above described panel member, a first getter chamber into which the above described panel members are conveyed after the above described bake processing and in which a getter processing is performed on interiors of the above described processing chambers, and a second getter processing chamber in which a getter processing is performed on the above described panel members into which the above described panel member is conveyed after the getter processing and which is adjacent to the above described first getter chamber, and the getter processing of the above described panel member is performed with the panel members in the above described second getter processing chamber set at a temperature lower than a temperature of the panel member subjected to the bake processing in the above described bake processing chamber.

Furthermore, the present invention provides a manufacturing method of an image displaying apparatus comprising steps of conveying panel member for composing a panel of the image displaying apparatus consecutively into a plurality of processing chambers equipped with temperature control means respectively and set in depressurized conditions, subjecting to a plurality of processings the above described panel member while controlling temperature and forming a panel by sealing the above described panel member, characterized in that: the above described plurality of processing chambers include a bake processing chamber for bake processing of the above described panel member, a surface clean processing chamber into which the panel member is conveyed after the above described bake processing and in which a surface clean processing is performed on the above described panel member, a first getter processing chamber into which the above described panel member is conveyed after the above described surface clean processing and in which a getter processing is performed on interiors of the above described processing chambers, and a second getter processing into which the above described panel member is conveyed after the above described getter processing, in which the getter processing is performed on the above described panel member and which is adjacent to the above described first getter processing chamber, and the getter processing is performed with the above described panel member in the above described second getter processing chamber set at a temperature lower than a temperature of the panel member subjected to the bake processing in the above described bake processing chamber.

Furthermore, the present invention provides a manufacturing method of an image displaying apparatus comprising steps of conveying panel member for composing a panel of an image displaying apparatus consecutively into a plurality of processing chambers equipped with temperature control means respectively and set in depressurized conditions, subjecting to a plurality of processings the above described panel member while controlling temperature and forming a panel by sealing the above described panel member, characterized in that: the above described plurality of processing chambers include a bake processing chamber for bake processing of the above described panel member, a cool processing chamber into which the above described panel member is conveyed after the above described bake processing and in which the above described panel member is cooled, and a getter processing chamber into which the above described panel member is conveyed after the cool processing and in which a getter processing is performed on the above described panel member.

Furthermore, the present invention provides a manufacturing method of an image displaying apparatus comprising steps of conveying panel member for composing a panel consecutively into a plurality of processing chambers equipped with temperature control means respectively and set in depressurized conditions, subjecting to a plurality of processings the above described panel member while controlling temperature and forming a panel by sealing the above described panel member, characterized in that: the above described plurality of processing chambers include a bake processing chamber for bake processing of the above described panel members, a cool processing chamber into which the above described panel members are conveyed after the above described bake processing and in which the above described panel member is cooled, a surface clean processing chamber in which a surface clean processing is performed on the above described panel member, and a getter processing chamber into which the above described panel member is conveyed after the above described surface clean processing and in which a getter processing is performed on the above described panel member.

Furthermore, the present invention provides a manufacturing method of an image displaying apparatus comprising steps of conveying panel member for composing a panel consecutively into a plurality of processing chambers which are equipped with temperature control means respectively and set in depressurized conditions, subjecting to a plurality of processings the above described panel member while controlling temperature and forming a panel by sealing the above described panel member, characterized in that: the above described plurality of processing chambers include a bake processing chamber for bake processing of the above described panel member, a cool processing chamber into which the above described panel member are conveyed after the above described bake processing and in which the above described panel member is cooled, a first getter processing chamber into which the above described panel member is conveyed after the above described cool processing and in which the getter processing is performed on interiors of the above described processing chambers, and a second getter processing chamber into which the above described panel member is conveyed after the above described getter processing, in which a getter processing is performed on the above described panel member and which is adjacent to the above described first getter processing chamber.

Furthermore, the present invention provides a manufacturing method of an image displaying apparatus comprising steps of conveying a panel member for composing a panel of an image displaying apparatus consecutively into a plurality of processing chambers equipped with temperature control means respectively and set in depressurized conditions, subjecting to a plurality of processings the above described panel member while controlling temperature and forming a panel by sealing the above described panel member, characterized in that: the above described plurality of processing chambers include a bake processing chamber for bake processing of the above described panel member, a cool processing chamber into which the above described panel member is conveyed after the above described bake processing and in which the above described panel member is cooled, a surface clean processing chamber into which the panel member is conveyed after the cool processing and in which a surface clean processing is performed on the panel member, and a first getter processing chamber into which the panel member is conveyed after the above described surface clean processing and a getter processing is performed on interiors of the above described processing chambers is performed, and a second getter processing chamber into which the above described panel member is conveyed after the above described getter processing, in which the getter processing is performed on the above described panel member and which is adjacent to the above described first getter processing chamber.

Furthermore, the present invention provide a manufacturing method of an image displaying apparatus including the steps of: a: conveying a first member including a substrate on which phosphor exciting means is disposed and a second member including a substrate on which a phosphor is disposed into a bake processing chamber filled with a depressurized atmosphere, and performing a bake processing by heating; b: conveying either or both of the above described first member and the above described second member through a depressurized atmosphere into a getter processing chamber filled with the depressurized atmosphere and performing a getter processing on the conveyed member or either or both of the conveyed members; and c: conveying the above described first member and the above described second member through a depressurized atmosphere into a seal processing chamber filled with the depressurized atmosphere and heating for sealing, characterized in that: the getter processing of the member or the members at the above described step b is performed at a temperature lower than a heating temperature at the above described step a.

Furthermore, the present invention provides a manufacturing method of an image displaying apparatus characterized by including the steps of: a: conveying a first member including a substrate on which phosphor exciting means is disposed and a second member including a substrate on which a phosphor is disposed into a bake processing chamber filled with a depressurized atmosphere, and heating for a bake processing; b: conveying either or both of the above described first member and the above described second member through a depressurized atmosphere into a cool processing chamber filled with the depressurized atmosphere and performing a cool processing; c: conveying either or both of the above described first member and the above described second member through a depressurized atmosphere into a getter processing chamber filled with the depressurized atmosphere and performing a getter processing on the conveyed member or either or both of the conveyed members; and d: conveying the above described first member and the above described second member through a depressurized atmosphere into a seal processing chamber filled with the depressurized atmosphere, and heating and sealing the first member and the second member.

Furthermore, the present invention provides a manufacturing method of an image displaying apparatus characterized by including the steps of: a: conveying a first member including a substrate on which phosphor exciting means is disposed and a second member including a substrate on which a phosphor is disposed into a bake processing chamber filled with a depressurized atmosphere, and heating for a bake processing; b: conveying either or both of the above described first member and the above described second member through a depressurized atmosphere into a surface clean processing chamber filled with the depressurized atmosphere and performing a surface clean processing on the conveyed member or either or both of the conveyed members; c: conveying either or both of the above described first member and the above described second member through a depressurized atmosphere into a getter processing chamber filled with the depressurized atmosphere, and performing a getter processing on the conveyed member or either or both of the conveyed members; and d: conveying the above described first member and the above described second member through a depressurized atmosphere into a seal processing chamber filled with the depressurized atmosphere, and heating for sealing.

Furthermore, the present invention provides a manufacturing method of an image displaying apparatus, characterized by including the steps of: a: conveying a first member including a substrate on which phosphor exciting means is disposed and a second member including a substrate on which a phosphor is disposed into a bake processing chamber filled with a depressurized atmosphere, and heating for bake processing; b: conveying either or both of the above described first member and the above described second member through a depressurized atmosphere into a surface clean processing chamber filled with the depressurized atmosphere, and performing a surface clean processing on the conveyed member or either or both of the conveyed members; c: conveying either or both of the above described first member and the above described second member through a depressurized atmosphere into a first getter processing chamber filled with the depressurized atmosphere, and performing a getter processing on an interior of the above described first getter processing chamber; d: conveying either or both of the above described first member and the above described second member through a depressurized atmosphere into a second getter processing chamber, and performing the getter processing on the conveyed member or either or both of the conveyed members; and e: conveying the above described first member and the above described second member through a depressurized atmosphere into a seal processing chamber filled with the depressurized atmosphere, and heating for sealing.

Furthermore, the present invention provides a manufacturing method of an image displaying apparatus, characterized by including the steps of: a: conveying a first member including a substrate on which phosphor exciting means is disposed and a second member including a substrate on which a phosphor is disposed into a bake processing chamber filled with a depressurized atmosphere, and heating for a bake processing; b: conveying either or both of the above described first member and the above described second member through a depressurized atmosphere into a cool processing chamber filled with the depressurized atmosphere, and performing a cool processing; c: conveying either or both of the above described first member and the above described second member through a depressurized atmosphere into a surface clean processing chamber filled with the depressurized atmosphere, and performing a surface clean processing on the conveyed member or either or both of the conveyed members; d: conveying either or both of the above described first member and the above described second member through a depressurized atmosphere into a getter processing chamber, and performing a getter processing on the conveyed member or either or both of the conveyed members; and e: conveying the above described first member and the above described second member through a depressurized atmosphere into a seal processing chamber filled with the depressurized atmosphere, and heating and sealing the first member and the second member.

Furthermore, the present invention provides a manufacturing method of an image displaying apparatus, characterized by including the steps of: a: conveying a first member including a substrate on which phosphor exciting means is disposed and a second member including a substrate on which a phosphor is disposed into a bake processing chamber filled with a depressurized atmosphere, and performing a bake processing; b: conveying either or both of the above described first member and the above described second member through a depressurized atmosphere into a cool processing chamber filled with the depressurized atmosphere, and performing a cool processing; c: conveying either or both of the above described first member and the above described second member through a depressurized atmosphere into a surface clean processing chamber filled with the depressurized atmosphere, and performing a surface clean processing on the conveyed member or either or both of the conveyed members; d: conveying either or both of the above described first member and the above described second member through a depressurized atmosphere into a first getter processing chamber filled with the depressurized atmosphere, and performing a getter processing on an interior of the above described first getter processing chamber; e: conveying either or both of the above described first member and the above described second member through a depressurized atmosphere into a second getter processing chamber filled with the depressurized atmosphere, and performing the getter processing on the conveyed member or either or both of the conveyed members; and f: conveying the above described first member and the above described second member through a depressurized atmosphere into a seal processing chamber, and heating for sealing.

Furthermore, the present invention provides a manufacturing apparatus of an image displaying apparatus characterized in that: disposed in a depressurized atmosphere are a getter processing chamber for performing a getter processing on either or both of a first member including a substrate on which phosphor exciting means is disposed and a second member including a substrate on which a phosphor is disposed, a seal processing chamber for performing a seal processing by heating the above described first member and the above described second member and conveying means which is capable of conveying the above described first member and the above described second member from the above described getter processing chamber to the above described seal processing chamber, and a heat shielding member is disposed between the above described getter processing chamber and the above described seal processing chamber.

Furthermore, the present invention provides a manufacturing apparatus of an image displaying apparatus characterized in that: disposed in a depressurized atmosphere are a bake processing chamber for performing a bake processing by heating the a first member including a substrate on which phosphor exciting means is disposed and a second member including a substrate on which a phosphor is disposed, a getter processing chamber for performing a getter processing on either or both of the above described first member and the above described second member, and conveying means which is capable of conveying the above described first member and the above described second member from the above described bake processing chamber into the above described getter processing chamber, and a heat shielding member is disposed between the above described bake processing chamber and the above described getter processing chamber.

Furthermore, the present invention provides a manufacturing apparatus of an image displaying apparatus, characterized in that: disposed in a depressurized atmosphere are a bake processing chamber for performing a bake processing by heating a first member including a substrate on which phosphor exciting means is disposed and a second member including a substrate on which a phosphor is disposed, a getter processing chamber for performing a getter processing on either or both of the above described first member and the above described second member, a seal processing chamber for performing a seal processing by heating the above described first member and the above described second member, and conveying means which is capable of conveying the above described first member and the above described second member into the bake processing chamber, the getter processing chamber and the seal processing chamber in this order, and a heat shielding members are disposed among pair of the above described processing chambers.

Furthermore, the present invention provides a manufacturing apparatus of an image displaying apparatus, characterized in that: disposed in a depressurized atmosphere are a bake processing chamber for performing a bake processing by heating a first member including a substrate on which phosphor exciting means is disposed and a second member including a substrate on which a phosphor is disposed, a cool processing chamber for slowly cooling either or both of the above described first member and the above described second member, a getter processing chamber for performing a getter processing on either or both of the above described first member and the above described second member, and conveying means which is capable of conveying the above described first member and the above described second member into the above described bake processing chamber, the above described cool processing chamber and the above described getter processing chamber in this order.

Furthermore, the present invention provides a manufacturing apparatus of an image displaying apparatus, characterized in that: disposed in a depressurized atmosphere are a bake processing chamber for performing a bake processing by heating a first member including a substrate on which phosphor exciting means is disposed and a second member including a substrate on which a phosphor is disposed, a cool processing chamber for slowly cooling either or both of the above described first member and the above described second member, a getter processing chamber for performing a getter processing on either or both of the above described first member and the above described second member, and a seal processing chamber for performing a seal processing by heating the above described first member and the above described second member, and a conveying means which is capable of conveying the above described first member and the above described second member into the above described bake processing chamber, the above described cool processing chamber and the above described getter processing chamber and the above described seal processing chamber in this order.

DETAILED DESCRIPTION OF THE PREFERRED EMBODIMENTS

Figure 1:
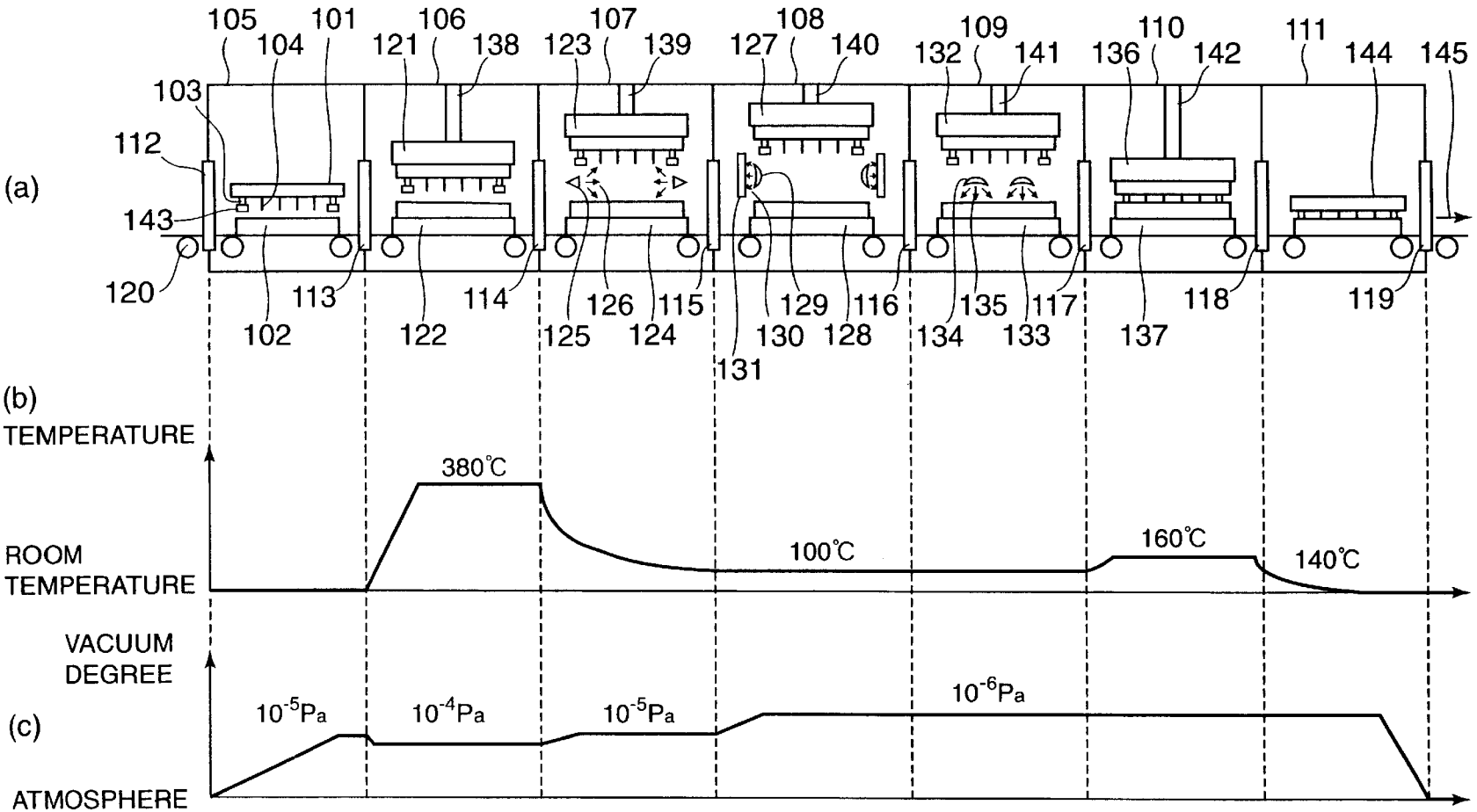
FIG. 1 is a diagram schematically showing a manufacturing apparatus according to the present invention together with a temperature profile of a panel member in the manufacturing apparatus and a vacuum degree profile in chambers of the manufacturing apparatus.

Of the present invention, a first invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, the manufacturing method of the image display apparatus, wherein the above described plurality of processing chambers include a bake processing chamber for performing a bake processing on the above described panel member and a getter processing chamber where the above described panel member is carried after the above described bake processing is over and the getter processing is performed on the above described panel member, wherein the above described getter processing is performed with the temperature of the panel member inside the above described getter processing chamber set at the temperature lower than the temperature of the panel member which is bake-processed in the above described bake processing chamber.

In the above first invention, the above described plurality of processing chambers include a front chamber adjacent to the above described getter chamber where the above described panel member is carried before being carried to the above described getter chamber after having been bake-processed in the above described bake processing chamber. The degree of vacuum inside the above described front chambers and the above described getter processing chambers is preferably set below $10^{-4}$ Pa.

Of the present invention, a second invention is a manufacturing method of an image display apparatus, wherein a panel member constituting the panel of an image display apparatus is carried in order to a plurality of depressurized processing provided respectively with temperature control means and, after performing a plurality of processings on the above described panel member by controlling temperatures, the above described panel member is sealed to form a panel, the manufacturing method of the image display apparatus, wherein the above described plurality of processing chambers include: a bake processing chamber for performing the bake processing on the above described panel member; a surface cleaning processing chamber for performing the surface cleaning processing on the above described panel member; a getter processing chamber where the above described panel member is carried after the above described surface cleaning processing is over and a getter processing is performed on the above described panel member, wherein the above described getter processing is performed with the temperature of the panel member in the above described getter processing chamber set at the temperature lower than the temperature of the panel member which is bake-processed in the above described bake processing chamber.

Moreover, in the above described second invention, it is preferable that the above described plurality of processing chambers include a front chamber adjacent to the above described getter processing chamber where the above described panel member is carried before being carried to the above described getter processing chamber after the surface cleaning processing in the above described surface cleaning processing chamber is over and, inside the front chamber and the above described getter processing chamber, the degree of vacuum is set below $10^{-4}$ Pa, or the above described surface purification chamber is adjacent to the above described getter chamber and, inside the above described surface purification chamber and the above described getter processing chamber, the degree of vacuum is set below $10^{-4}$ Pa, or the above described surface cleaning processing is the processing for irradiating electron beams on the surface of the carried member and purifying the above described member, or the above described surface cleaning processing is the processing for irradiating ions on the surface of the carried member and purifying the above described member, or the above described surface cleaning processing is the processing for irradiating ultraviolet rays on the surface of the carried member and purifying the above described member, or the above described surface cleaning processing is the processing for irradiating plasma on the surface of the carried member and purifying the above described member.

Moreover, in the above described first and second inventions, it is preferable that the getter processing inside the getter processing chamber is further performed in the above described getter processing chamber, or the sealing of the above described panel member is performed with the temperature of the above described panel member set at the temperature higher than the temperature of the panel member which is getter-processed in the above described getter processing chamber.

Of the present invention, a third invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, wherein the above described plurality of processing chambers have: the bake processing chamber for performing the bake processing on the above described panel; a first getter processing chamber into which the above described panel members are conveyed after the bake processing, for performing a getter processing inside the processing chamber; and a second getter processing chamber adjacent to the above described first getter processing camber where the above described panel member is carried after the above described getter processing is over and the getter processing is performed on the above described panel member, wherein the getter processing of the above described panel member is performed with the temperature of the panel member in the above described second getter processing chamber set at the temperature lower that the temperature of the panel member which is bake-processed in the above described bake processing chamber.

Moreover, in the above third invention, it is preferable that the above described plurality of processing chambers include the front chamber adjacent to the first getter processing chamber where the above described panel member is carried before being carried to the above described first getter processing chamber after the bake processing in the above described bake processing chamber is over and, inside the front chambers and the above described first and second getter chambers, the degree of vacuum is set below $10^{-4}$ Pa.

Of the present invention, a fourth invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, wherein the above described plurality of processing chambers have: the bake processing chamber for performing the bake processing on the above described panel member; the surface purification chamber where the above described panel is carried after the above described bake processing is over and the surface cleaning processing of the above described panel member is performed; a first getter processing chamber where the above described panel is carried after the above described surface cleaning processing is over and the getter processing inside the processing chamber is performed; and a second getter processing chamber adjacent to the above described first getter processing chamber where the above described panel member is carried after the above described getter processing is over and the getter processing is performed on the above described panel member, wherein the getter processing to the above described panel is performed with the temperature set at the temperature lower than the temperature of the panel member which is bake-processed in the above described bake processing chamber.

Moreover, in the above described fourth invention, it is preferable that the above described surface purification chamber is adjacent to the above described first getter processing chamber and, inside the above surface purification chamber and the above described first and second getter chambers, the degree of vacuum is set below $10^{-4}$ Pa, or the above described surface cleaning processing is the processing for irradiating the electron beam on the carried member and purifying the surface of the above described member, or the above described surface cleaning processing is the processing for irradiating ions on the carried member and purifying the surface of the above described member, or the above described surface cleaning processing is the processing for irradiating ultraviolet rays on the carried member and purifying the surface of the above described member, or the above described surface cleaning processing is the processing for irradiating plasma on the carried member and purifying the surface of the above described member.

Moreover, in the above described third and fourth inventions, it is preferable that the sealing of the above described panel member is performed with the temperature of the above described panel member set at the temperature higher than the temperature of the panel member which is getter-processed in the above described second getter processing chamber.

Of the present invention, a fifth invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, wherein the above described plurality of processing chambers have: the bake processing chamber for performing the bake processing on the above described panel member; a cooling processing chamber into which the above described panel members are conveyed after the bake processing, for cooling the above described panel member; and the getter processing chamber to which the above described panel members are conveyed after the cool processing, for performing the getter processing on the above described panel member.

Moreover, in the above described fifth invention, it is preferable that the above described plurality of processing chambers include the front chamber adjacent to the above described getter chamber where the above described panel member is carried before being carried to the above described getter processing chamber after a cooling processing in the above described cooling processing chamber is over and, inside the above described front chamber and the above described getter processing chamber, the degree of vacuum is set below $10^{-4}$ Pa, or the above described cooling chamber is adjacent to the above described getter processing chamber and, inside the above described cooling processing chamber and the above described getter processing chamber, the degree of vacuum is set below $10^{-4}$ Pa, or in the above described getter processing chamber, a getter processing inside the getter processing chamber is further performed, or in the above described cooling processing chamber, a surface cleaning processing of the above described panel member is further performed, or in the above described cooling processing chamber, the getter processing inside the cooling chamber is further performed, or in the above described cooling processing chamber, the surface cleaning processing of the above described panel member and the getter processing inside the above described cooling processing chamber are further performed, or the above described surface cleaning processing is the processing for electron beams on the carried member and purifying the surface of the above described member, or the above described surface cleaning processing is the processing for irradiating ions on the surface of the carried member and purifying the surface of the above described member, or the above described surface cleaning processing is the processing for irradiating ultraviolet rays on the surface of the carried member and purifying the surface of the above described member, or the above described surface cleaning processing is the processing for irradiating plasma on the surface of the carried member and purifying the surface of the above described member.

Of the present invention, a sixth invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, wherein the above described plurality of processing chambers have: the bake processing chamber for performing the bake processing on the above described panel member; the cooling processing chamber where the above described panel member is carried after the above described bake processing is over and the above described panel member is cooled; the surface cleaning processing chamber where the above described panel member is carried after the above described cooling processing is over and the surface cleaning processing of the above described panel member is performed; and the getter processing chamber where the above described panel member is carried after the above described surface cleaning processing is over and the getter processing is performed on the above panel member.

Moreover, in the above described sixth invention, it is preferable that the above described plurality of processing chambers include the front chamber adjacent to the above described getter processing chamber where the above described panel member is carried before being carried to the above described getter processing chamber after the surface cleaning processing in the above described surface processing chamber is over and, inside the front chamber and the getter processing chamber, the degree of vacuum is set below $10^{-4}$ Pa, or the above surface cleaning processing chamber is adjacent to the above described getter processing chamber and, inside the above described surface cleaning processing chamber and the above described getter processing chamber, the degree of vacuum is set below $10^{-4}$ Pa, or in the above descried getter processing chamber, the getter processing inside the getter processing chamber is further performed, or the above described surface cleaning processing is the processing for irradiating electron beams on the surface of the carried member and purifying the surface of the above described member, or the above described surface cleaning processing is the processing for irradiating ions on the surface of the carried member and purifying the surface of the above described member, or the above described surface cleaning processing is the processing for irradiating ultraviolet rays on the carried member and purifying the surface of the above described member, or the above described surface cleaning processing is the processing for irradiating plasma on the surface of the carried member and purifying the surface of the above described member.

Moreover, in the above fifth and sixth inventions, it is preferable that the sealing of the above described panel member is performed with the temperature of the above described panel member set at the temperature higher than the temperature of the panel member which is getter-processed in the above getter processing chamber.

Of the present invention, a seventh invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, wherein the above described plurality of processing chambers have: the bake processing chamber for performing the bake processing on the above described panel; the cooling processing chamber where the above described panel member is carried after the above described bake processing is over and the above described panel member is cooled; a first getter processing chamber where the above described panel member is carried after the above descried cooling process is over and the getter processing inside the processing chamber is performed; and a second getter processing chamber adjacent to the above described first getter processing chamber where the above described panel member is carried after the above described getter processing is over and the getter processing is performed on the above described panel member.

Moreover, in the above described seventh invention, it is preferable that the above described cooling chamber is adjacent to the above described first getter processing chamber and inside the above described cooling processing chamber and the above described first and second getter processing chambers, the degree of vacuum is set below $10^{-4}$ Pa, or in the above described surface cleaning processing chamber, a surface cleaning processing of the above described panel member is further performed, or the above described surface cleaning processing is the processing for irradiating electron beams on the surface of the carried member and purifying the surface of the above described member, or the above described surface cleaning processing is the processing for irradiating ions on the surface of the carried member and purifying the surface of the above described member, or the above described surface cleaning processing is the processing for irradiating ultraviolet rays on the surface of the carried member and purifying the surface of the above described member, or the above described surface cleaning processing is the processing for irradiating plasma on the surface of the carried member and purifying the surface of the above described member.

Of the present invention, an eighth invention is a manufacturing method of an image display apparatus, wherein a panel member constituting the panel of an image display apparatus is carried in order to a plurality of depressurized processing chambers provided respectively with temperature control means and, after performing a plurality of processings on the above described panel member by controlling temperatures, the above described panel member is sealed to form a panel, wherein the above described plurality of processing chambers have: the bake processing chamber for performing the bake processing on the above described panel member; the cooling processing chamber where the above described panel member is carried after the above bake processing is over and the above described panel is cooled; a surface cleaning processing chamber where the above described panel member is carried after the above described cooling processing is over and the surface cleaning processing of the above described panel member is performed; a first getter processing chamber where the above described panel member is carried after the above described surface cleaning processing is over and the getter processing inside the processing chamber is performed; and a second getter processing chamber adjacent to the above described first getter processing chamber where the above described panel member is carried after the above described getter processing is over and the getter processing is performed on the above described panel member.

Moreover, in the above described eighth invention, it is preferable that the above described surface cleaning processing chamber is adjacent to the above described first getter processing chamber and, inside the above described surface cleaning processing chamber and the above described first and second getter processing chambers, the degree of vacuum is set below $10^{-4}$ Pa, or the above described surface cleaning processing is the processing for irradiating electron beams on the surface of the carried member and purifying the surface of the above described member, or the above described surface cleaning processing is the processing for irradiating ions on the surface of the carried member and purifying the surface of the above described member, or the above described surface cleaning processing is the processing for irradiating ultraviolet rays on the surface of the carried member and purifying the surface of the above described member, or the above described surface cleaning processing is the processing for irradiating plasma on the surface of the carried member and purifying the surface of the above described member.

Moreover, in the above described seventh to eighth inventions, it is preferable that the sealing of the above described panel member is performed with the temperature of the above described panel set at the temperature higher than the temperature of the panel member which is getter-processed in the above described second getter processing chamber.

Moreover, in the above described first to eighth inventions, it is preferable that the above described panel member has a face plate constituting a display face of the above described panel and sealed with a rear plate constituting the back of the above described panel which is spaced from the face plate and oppositely arranged, or at the above described rear plate side, a first sealing material for sealing with the above panel member is disposed, or at the above described rear plate side, an outer frame constituting the side surface of the above described panel fixed by the second sealing material and the first sealing material for sealing with the above described panel member portion arranged in the outer frame are disposed, or the above described second sealing material is higher in its melting point than that of the above described first sealing material, or the above described first sealing material is an low melting point metal or the alloy thereof, or the above described second sealing material is a frit glass.

Moreover, in the above described first to eighth inventions, the above described panel member has further the first sealing material arranged at the above described face plate side and is sealed with the above described rear plate by the above described first sealing material, or at the above described rear plate side, the outer frame constituting the side surface of the above described panel fixed by the second sealing material is disposed, or the above described second sealing material is higher in its melting point than that of the above described first sealing material, or the above described sealing material is a low melting point metal or the alloy thereof, or the above described second sealing material is a frit glass.

Moreover, in the above described seventh to eighth inventions, it is preferable that the above described panel member has further the outer frame constituting the above described panel side surface fixed at the above described face plate by the second sealing material and is sealed with the above described rear plate, or at the above described rear plate, the first sealing material for sealing with the above described panel member is disposed, or the above described second sealing material is higher in its melting point than that of the above described first sealing material, or the above described first sealing material is a low melting point metal or the alloy thereof, or the above described second sealing material is a frit glass.

Moreover, in the above described seventh to eighth inventions, it is preferable that the above described panel member has further the outer frame constituting the above described panel side surface fixed at the above described face plate by the second sealing material and first sealing material arranged at the outer frame, and the panel member is sealed by the above described rear plate and the above described first sealing material, or the above described second sealing material is higher in its melting point than that of above described first sealing material, or the above described first sealing material is a low melting point metal or its alloy, or the above described second sealing material is a frit glass.

Moreover, in the above described first to eighth inventions, it is preferable that the above described panel member has a rear plate constituting the back of the above described panel which is spaced from the face plate constituting the display surface of the above described panel and oppositely arranged and is sealed with the above described face plate, or at the above described face plate side, the first sealing material for sealing with the above described panel member is disposed, or at the above described face plate side, the outer frame constituting the above described panel side surface fixed by the second sealing material and the first sealing material for sealing with the above described panel arranged on the outer frame are disposed, or the above described second sealing material is higher in its melting point than that of the first sealing material, or the above described first sealing material is a low melting point metal or the alloy thereof, or the above described second sealing material is a frit glass.

Moreover, in the above described first to eighth inventions, it is preferable that the above described panel member has further the first sealing material arranged on the above described rear plate and is sealed with the above described face plate by the above described first sealing material, or at the above described face plate, the outer frame constituting the above described panel side surface fixed by the second sealing material, or the above described second sealing material is higher in its melting point than that of the first sealing material, or the above described first sealing material is a low melting point metal or the alloy thereof, or the above described second sealing material is a frit glass.

Moreover, in the above described first to eighth inventions, it is preferable that the above described panel member has further the outer frame constituting the above described panel side surface fixed at the above described rear plate by the second sealing material, or at the above described face plate side, the first sealing material for sealing with the above described panel member is disposed, or the above described second sealing material is higher in its melting point than that of the above described first sealing material, or the above described first sealing material is a low melting point metal or the alloy thereof, or the above described second sealing material is a frit glass.

Moreover, in the above described first to eighth inventions, it is preferable that the above described panel member further has an outer frame constituting the above described panel side surface fixed to the rear plate by the second sealing material, and the first sealing material disposed at the outer frame, and the above described panel member is sealed by the face plate and the first sealing material, or the above described second sealing material is higher in its melting point than that of the first sealing material, or the above described first sealing material is a low melting point metal or the alloy thereof, or the above described second sealing material is a frit glass.

Moreover, in the above described first to eighth inventions, it is preferable that the above described face plate has a phosphor, or the above described face plate has the phosphor and a metal back, or the above described rear plate has a phosphor exciting means, or the above described phosphor exciting means has an electron emitting element.

Of the present invention, a ninth invention is, in a manufacturing method of an image display apparatus, the manufacturing method of the image display apparatus comprising the steps of:

a: carrying a first member including a substrate where the phosphor exciting means is arranged and a second member including a substrate where the phosphor is arranged into the bake processing chamber of the vacuum atmosphere for heating and bake-processing, b: carrying either of the above described first member or the above described second member or both of the members into the getter processing chamber of the vacuum atmosphere under the vacuum atmosphere for performing the getter processing on one of the carried members or either of both carried members or both carried members and c: carrying the above described first member and the above described second member into the sealing processing chamber of the vacuum atmosphere under the vacuum atmosphere for heating and sealing, wherein the above described step b is performed with the temperature of the getter-processed member set at the temperature lower than the heating temperature in the above described step a.

Of the present invention, a tenth invention is, in a manufacturing method of an image display apparatus, the manufacturing method of the image display apparatus comprising the steps of:

a: carrying a first member including a substrate where the phosphor exciting means is arranged and a second member including a substrate where the phosphor is arranged into the bake processing chamber of the vacuum atmosphere for heating and bake-processing, b: carrying either of the above described first member or the above described second member or both of the members into the cooling processing chamber under the vacuum atmosphere for cool-processing, c: carrying either of the above described first member or the above described second member or both of the members into the getter processing chamber of the vacuum atmosphere under the vacuum atmosphere for performing the getter processing on one of the carried members or either of both the carried members or both of the carried members, and d: carrying the above described first member and the above described second member into the sealing processing chamber of the vacuum atmosphere under the vacuum atmosphere for heating and sealing.

Moreover, in the above described tenth invention, it is preferable that the surface cleaning processing is performed on one of the carried members or either of both the carried members or both of the carried members in the cooling processing chamber at the above described step b, or in the cooling processing chamber at the above described step b, the surface cleaning processing and the getter processing inside the above described cooling processing chamber are performed on one of the carried members or either of both the carried members or both of the carried members.

Of the present invention, an eleventh invention is, in an manufacturing method of the image display apparatus, the manufacturing method of the image display apparatus comprising the steps of:

a: carrying a first member including a substrate where the phosphor exciting means is arranged and a second member including a substrate where the phosphor is arranged into the bake processing chamber of the vacuum atmosphere for heating and bake-processing, b: carrying either of the above described first member or the above described second member or both of the members into the surface cleaning processing chamber of the vacuum atmosphere under the vacuum atmosphere for performing the surface cleaning processing on one of the carried members or either of both the carried members or both of the carried members, c: carrying either of the above described first member or the above described second member or both of the members into the getter processing chamber of the vacuum atmosphere under the vacuum atmosphere for performing the getter processing on one of the carried members or either of the carried members or both of the carried members, and d: carrying the above described first member and the above described second member into the sealing processing chamber of the vacuum atmosphere under the vacuum atmosphere for heating and sealing.

Moreover, in the above described eleventh invention, it is preferable that, inside the surface cleaning processing chamber of the above described step b, the getter processing inside the surface cleaning processing chamber is performed, or inside the surface cleaning processing chamber of the above described step b, one of the carried members or both of the carried members are cooled.

Of the present invention, a twelfth invention is, in a manufacturing method of an display apparatus, the manufacturing method of the image display apparatus comprising of the steps of:

a: carrying a first member including a substrate where the phosphor exciting means is arranged and a second member including a substrate where the phosphor is arranged into the bake processing chamber of the vacuum atmosphere for heating and bake-processing, b: carrying either of the above described first member or the above described second member or both of the members into the surface cleaning processing chamber of the vacuum atmosphere under the vacuum atmosphere for performing the surface cleaning processing on one of the carried members or either of both the carried members or both of the carried members, c: carrying one of the above described first member and the above described second member or both of the members into the first getter processing chamber of the vacuum atmosphere under the vacuum atmosphere for performing the getter processing inside the above described first getter processing chamber, d: carrying one of the above described first member and the above described second member or both of the members into the second getter processing chamber of the vacuum atmosphere under the vacuum atmosphere for performing the getter processing on one of the carried members or either of both carried members or both of the members, and e: carrying the above described first member and the above described second member into the sealing processing chamber of the vacuum atmosphere under the vacuum atmosphere for heating and sealing.

Moreover, in the above described twelfth invention, it is preferable that inside the surface cleaning processing chamber of the above described step b, the cooling of one of the carried members or both of the carried members are performed.

Of the present invention, a thirteenth invention is, in a manufacturing method of an image display apparatus, the manufacturing method of the image display apparatus comprising the steps of:

a: carrying a first member including a substrate where the phosphor exciting means is arranged and a second member including a substrate where the phosphor is arranged into the bake processing chamber of the vacuum atmosphere for heating and bake-processing, b: carrying either one of the above described first member and the above described second member or both of the members into the cooling processing chamber of the vacuum atmosphere under the vacuum atmosphere for cool-processing, c: carrying either one of the above described first member and the above described second member or both of the members into the surface cleaning processing chamber of the vacuum atmosphere under the vacuum atmosphere for performing the surface cleaning processing on one of the carried members or either of both the carried members or both of the carried members, d: carrying either one of the above described first member and the above described second member or both of the members into the getter processing chamber of the vacuum atmosphere under the vacuum atmosphere for performing the getter processing on one of the carried members or either of both the carried members or both of the carried members, and e: carrying the above described first member and the above described second member into the sealing processing chamber of the vacuum atmosphere under the vacuum atmosphere for heating and sealing.

Of the present invention, a fourteenth invention is, in a manufacturing method of an image display apparatus, the manufacturing method of the image display apparatus comprising the steps of:

a: carrying a first member including a substrate where the fluorescent means is arranged and a second member including a substrate where the phosphor is arranged into the bake processing chamber of the vacuum atmosphere for heating and bake-processing, b: carrying either one of the above described first member and the above described second member or both of the members into the cooling processing chamber of the vacuum atmosphere under the vacuum atmosphere for cool-processing, c: carrying either one of the above described first member and the above described second member or both of the members into the surface cleaning processing chamber of the vacuum atmosphere under the vacuum atmosphere for performing the surface cleaning processing on one of the carried members or either of both the carried members or both of the carried members, d: carrying either one of the above described first member and the above described second member or both of the members into the first getter processing chamber of the vacuum atmosphere under the vacuum atmosphere for performing the getter processing inside the above described first getter processing chamber, e: carrying either one of the above described first member and the above described second member or both of the members into the second getter processing chamber of the vacuum atmosphere under the vacuum atmosphere for performing the getter processing on one of the carried members or either of both the carried members or both of the carried members, and f: carrying the above described first member and the above described second member into the sealing processing chamber of the vacuum atmosphere under the vacuum atmosphere for heating and sealing.

Moreover, in the above described ninth to fourteenth inventions, what is meant by the getter processing inside the cooling processing chamber and the surface purification processing chamber, or the getter processing inside the first getter processing chamber is the processing performed for the purpose of raising the degree of vacuum for each processing chamber and the processing for forming a getter film for the component of the image display apparatus and forming the getter film for the non-component of the image display apparatus arranged inside the processing chamber.

Moreover, in the above described ninth to fourteenth inventions, what is meant by the surface cleaning processing is the processing for purifying the surface of the above described member and it is preferable that electron beams, ions, ultraviolet rays or plasma are irradiated on the surface of the member.

Moreover, in the above described ninth to fourteenth inventions, the getter processing of the above described member is preferably performed, while the above described member is being heated.

Of the present invention, a fifteenth invention is, in a manufacturing method of an image display apparatus, the manufacturing method of the image display apparatus comprising: the getter processing chamber for performing the getter processing on either of the first member including the substrate where the phosphor exciting means is arranged or the above described second member including the substrate where the phosphor is arranged or both of the members under the vacuum atmosphere; and the sealing processing chamber for heating and seal-processing the above described first member and the above described second member, wherein a carrying means capable of carrying the above described first member and the above described second member from the above described getter processing chamber into the above described sealing processing chamber is provided, and wherein a thermal shutdown member is disposed between the above described getter processing camber and the above described sealing processing chamber.

Of the present invention, a sixteenth invention is, in a manufacturing method of an image display apparatus, the manufacturing method of the image display apparatus comprising the bake processing chamber for heating and bake-processing the above described first member including the substrate where the phosphor exciting means is arranged and the above described second member including the substrate where the phosphor is arranged and the getter processing chamber for performing the getter processing on either of the above described first member or the above described second member or both of the members, wherein the carrying means capable of carrying the above described first member and the above described second member from the above described bake processing chamber into the above described getter processing chamber is provided, and wherein the thermal shutdown member is disposed between the above described bake processing chamber and the above described getter processing chamber.

Of the present invention, a seventeenth invention is, in a manufacturing method of an image display apparatus, the manufacturing method of the image display apparatus comprising: the bake processing chamber for heating and bake-processing the first member including the substrate where the phosphor exciting means are arranged and the second member including the substrate where the phosphor is arranged; the getter processing chamber for performing the getter processing on either of the above described first member or the above described second member or both of the member; and the sealing processing chamber for heating and sealing the above described first member and the above described second member, wherein the carrying means capable of carrying the above described first member and the above described second member in order into the bake processing chamber, the getter processing chamber and the sealing processing chamber is provided, and wherein the thermal shutdown member is disposed between the above described each processing chamber.

Of the present invention, an eighteenth invention is, in a manufacturing method of an image display apparatus, the manufacturing method of the image display apparatus comprising: the bake processing chamber for heating and bake-processing under the vacuum atmosphere the first member including the substrate where the phosphor exciting means is arranged and the second member including the substrate where the phosphor is arranged; the cooling processing chamber for cooling either of the above described first member or the above described second member or both of the members; and the getter processing chamber for performing the getter processing on either of the above described member or the above described second member or both of the members, wherein the carrying means capable of carrying the above described first member and the above described second member in order into the above described bake processing chamber, the above described cooling processing chamber and the above described getter processing chamber is provided.

Moreover, in the above described eighteenth invention, it is preferable that the thermal shutdown member is disposed between the above described bake processing chamber and the above described cooling processing chamber, or the thermal shutdown member is disposed between each processing chamber.

Of the present invention, a nineteenth invention is, in a manufacturing method of an image display apparatus, the manufacturing method of the image display apparatus comprising: the bake processing chamber for heating and bake-processing the first member including the substrate where the phosphor exciting means is arranged and the second member including the substrate where the phosphor is arranged; the cooling processing chamber for cooling either of the above described first member or the above described second member or both of the members; the getter processing chamber for performing the getter processing on either of the above described first member or the above described second member or both of the members; and the sealing processing chamber for heating and seal-processing the above described first member and the above described second member, wherein the carrying means capable of carrying the above described first member and the above described second member in order into the above described bake processing chamber, the above described cooling processing chamber and the above described getter processing chamber is provided.

Moreover, in the above described nineteenth invention, it is preferable that the thermal shutdown member is disposed between the above described bake processing chamber and the above described cooling processing chamber, or the thermal shutdown member is disposed between the above described getter processing chamber and the above described sealing processing chamber, or the thermal shutdown member is disposed between the above described bake processing chamber and the above described cooling processing chamber and between the above described getter processing chamber and the above described sealing processing chamber, or the thermal shutdown member is disposed between each processing chamber.

Here, in the above described fifteenth to nineteenth inventions, it is preferable that the above described thermal shutdown member is formed by a reflective metal.

Moreover, in the above described ninth to nineteenth inventions, it is preferable that the above described first member has the substrate where the phosphor exciting means is arranged and the outer frame, or the substrate where the phosphor excising means is arranged and a spacer, or the substrate where the phosphor exciting means is arranged, the outer frame and a spacer.

Or it is preferable that the above described second member has the substrate where the phosphor is arranged and the outer frame, or the substrate where the phosphor is arranged and the spacer, or the substrate where the phosphor is arranged, the outer frame and the spacer.

Moreover, in the above described ninth to nineteenth inventions, it is preferable that the getter used for the above getter processing is an evaporating getter, or the above described phosphor exciting means has the electron emitting element.

In the above described inventions, each processing chamber is disposed under the vacuum atmosphere and, therefore, the temperature of the first or the second member can be set independently for each processing chamber so that the time required for raising or lowering the processing temperature can be sharply shortened.

Moreover, in the above described inventions, performing the getter processing by setting the temperature of the member which is getter-processed at the temperature lower than the temperature of the member which is bake processed makes it possible to sharply reduce deterioration of the getter film formed on the above described members due to heat.

Moreover, in the above described inventions, setting a reduced pressure state inside the front chamber or the proceeding processing chamber adjacent to the getter processing chamber at below $10^{-4}$ Pa, or more preferably, at below $10^{-5}$ Pa makes it possible to prevent an extreme lowering of the degree of vacuum inside the getter processing chamber at the time when the member is carried into the getter processing chamber and reduce a waiting time until the getter processing from the time when the member is carried into the getter processing chamber.

Moreover, in the above described inventions, performing the getter processing while the member getter-processed is being heated makes it possible to reduce the difference in the temperature between the getter processing step and the heating step before and after that and, in addition to preventing a breakdown due to extreme raising of the temperature of the first member or the second member, also reduce the difference in the temperatures of the above described first or the second member between the getter processing step and the sealing processing step so that the time required for raising the temperature at the time of the sealing step is sharply reduced.

Moreover, in the above described inventions, having the cooling processing or the cooling processing chamber makes it possible not only to prevent a breakdown of the first or the second member due to extreme raise of the temperature, but also to sharply prevent deterioration of the getter film formed in the above described member due to heat by disposing the member between the bake processing step and the getter processing step.

Moreover, in the above described inventions, performing the surface cleaning processing of the first or the second member inside the processing chamber where the cooling processing or the like are performed makes it possible to use the remaining heat in the proceeding step such as the bake processing step for the surface purification of the above described member so that the surface cleaning processing can be performed more efficiently.

Moreover, in the above described inventions, performing the surface cleaning processing after the thermal processing step on the first or the second member such as the bake processing step or the like is over makes it possible to use the remaining heat in the above described thermal processing step for the surface purification of the above described member so that the surface cleaning processing can be performed more efficiently.

Moreover, in the above described inventions, disposing the thermal shutdown member between the getter processing chamber and the sealing processing chamber or between the bake processing chamber and the getter processing chamber makes it possible to sharply reduce deterioration of the getter film due to heat.

Moreover, in the above described inventions, fixing the outer frame on the face plate or the rear plate by using the second sealing material of a high melting point makes it possible to prevent deviation in the position between the above described plate and the outer frame due to softening of the second sealing material by the sealing processing temperature of the first sealing material in the sealing processing chamber.

Embodiments (a) of FIG. 1 is a typical drawing to show a manufacturing apparatus according to the present invention, (b) of FIG. 1 is a panel member of an image display apparatus, that is, a temperature profile showing the temperature of the above described first member or second member and (c) of FIG. 1 is a vacuum profile showing the degree of vacuum inside the manufacturing apparatus. Hereunder, one example of the manufacturing method and the manufacturing apparatus according to the present invention will be described based on the above drawings.

In (a) of FIG. 1, reference numeral 101 denotes a rear plate (hereinafter referred to as RP) which is a panel member and where an electron source as a phosphor exciting means is formed where a plurality of electron emitting elements are matrix-wired. Reference numeral 102 denotes a face plate (hereinafter referred to as FP) which is a panel member where a phosphor, a metal back or the like are formed. Reference numeral 103 denotes an outer frame which is a panel member and arranged between the RP101 and the FP102 and constitutes a panel which is an airtight container together with the RP101 and the FP102. Reference numeral 104 is a spacer which keeps a space between the RP101 and the FP102. The present embodiment shows a case where the outer frame 103 and the spacer 104 are arranged and fixed in advance on the RP101.

Reference numeral 105 denotes a front chamber, reference numeral 106 a bake processing chamber, reference numeral 107 a surface cleaning processing chamber, reference numeral 108 a first getter processing chamber (chamber getter processing chamber), reference numeral 109 a second getter processing chamber (panel getter processing chamber), reference numeral 110 a sealing processing chamber and reference numeral 111 a cooling chamber, which are arranged and connected in order in a carrying direction (an arrow mark 145 in the drawing), for each of which the air is exhausted by a vacuum pump(not shown) and a vacuum atmosphere is formed.

In the present embodiment, the above described surface cleaning processing chamber 107 becomes an electron beam irradiating chamber (hereinafter referred to as EB irradiating chamber) where an electron beam irradiating means is disposed. The atmosphere and each processing chamber are set apart by gate valves 112, 113, 114, 115, 116, 117 118 and 119, and the RP101 and the FP102 which are the panel members, the outer frame 103 and the spacer 104 are carried into the front chamber 105 by the opening and the closing of the gate valve 112 and move to each processing chamber in order by the opening and the closing of each gate valve. Reference numeral 120 denotes a carrying roller for moving the panel members to each processing chamber.

Moreover, reference numerals 121, 123, 127, 132 and 136 are hot plates for heating the RP101 and the outer frame 103 and the spacer 104 fixed thereon. On the other hand, reference numerals 122, 124, 128, 133 and 137 are hot plates for heating the FP102.

Reference numeral 125 is an electron gun for EB-irradiating inside EB irradiating processing chamber 107 and reference numeral 126 is an electron beam irradiated from the electron gun 125. Inside the chamber getter processing chamber 108, reference numeral 129 denotes a chamber getter flush device, reference numeral 130 a chamber getter flush generated from the chamber getter flush device, which is the material such as Ba instantaneously evaporated. Reference numeral 131 denotes a chamber getter board, which performs an exhausting action as a chamber getter with the chamber getter flush adhered 130, that is, which can raise the degree of vacuum inside the chamber getter processing chamber 108.

In the panel getter processing chamber 109, reference numeral 134 denotes a panel getter flush device and reference numeral 135 denotes a panel getter flush generated from the panel getter flush device 134, where the material such as Ba or the like is instantaneously evaporated and adhered to the FP102.

Reference numerals 138, 139, 140, 141 and 142 denote lifts, which support the hot plates 121, 123, 127, 132 and 136 respectively and have a function to lift the RP101 to a height necessary for each processing step.

(b) of FIG. 1 shows a step at each processing chamber in the manufacturing apparatus of (a) of FIG. 1 in the axis of abscissas and a temperature profile of the panel member in the step at each processing chamber in the axis of ordinates. The temperature profile shows a temperature state of the RP101, the FP102. Moreover, (c) of FIG. 1 shows a step at each processing chamber in the manufacturing apparatus of (a) of FIG. 1 in the axis of abscissas and the degree of vacuum profile at each processing chamber in the axis of ordinates.

The RP101 and the FP102, the outer frame 103 and the space 104 pass through each processing chamber in the direction of the arrow 145 by the drive of the carrying roller 120 which is carrying means and receive various kinds of processings during this passing.

In the present embodiment, first under the vacuum atmosphere of the front chamber 105, the first member comprising the RP101 where the electron source is arranged, the outer frame 103 and the spacer 104 and the second member comprising the FP102 where the phosphor and the metal back are arranged are prepared, and each step of: bake processing in the bake processing chamber 106, irradiating electron beams in the EB irradiating processing chamber 107, reaching the high degree of vacuum by the chamber getter processing in the chamber getter processing chamber 108, adhering the getter flush to the panel by the panel getter processing in the panel getter processing chamber 109, heat sealing in the sealing processing chamber 110 and cooling processing in the cooling chamber 111 is performed in series on one line.

Between each processing chamber of the manufacturing apparatus as shown in (a) of FIG. 1, the gate valves 112, 113, 114, 115, 116, 117, 118 and 119 are arranged as described above and each processing chamber is vacuum-exhausted by a vacuum exhausting system (not shown). In the present embodiment, though the gate valves 112, 113, 114, 115, 116, 117, 118 and 119 are arranged respectively between each processing chamber, this arrangement of the gate valve may be made only between processing chambers which are different in the degree of vacuum of the vacuum degree profile as shown in (c) of FIG. 1 and between the atmosphere outside the apparatus, and for example, the gate valves 116, 117 between the chamber getter processing chamber 108, the panel getter processing chamber 109 and the sealing chamber 110 may be omitted.

When there is no gate vale available between adjacent processing chambers as described above and the temperature of the panel member in each processing step is different, it is preferable that between these steps there is arranged a thermal shutdown member (in the shape of such as a board, a film or the like) formed by a reflective metal, for example, such as aluminum, chrome, stainless or the like. This thermal shutdown member is preferably arranged between the processing chambers where the temperature of the temperature profile of the panel member as shown in FIG. 1B differs, for example, somewhere between the bake processing chamber 106 and the panel getter processing chamber 109, or between the panel getter processing chamber 109 and the sealing processing chamber 110, or between both of the above described chambers. Moreover, the thermal shutdown member may be arranged between each processing chamber. The above described thermal shutdown member is disposed in such a manner that no trouble occurs when the FP102 and RP101 mounted thereon moves between each processing chamber.

Moreover, in the present embodiment, though the outer frame 103 for sealing a vacuum structure and the spacer 104 for forming an atmospheric pressure proof structure are fixed to the RP101 prior to being carried into the front chamber 105, the configuration thereof is not limited to this. For example, the spacer 104 may be fixed in advance to the outer frame 103 (for example, as a board like spacer 104 crossing inside the outer frame 103 and both ends thereof are fixed to the outer frame 103), which is introduced inside the main apparatus as a single component member apart from the RP101 and FP102 and is processed at each processing step and finally arranged and fixed at a desired position as the panel component member in the sealing processing step, or the outer frame 103 may be fixed and arranged on the FP102 in advance.

Note that, when the outer frame 103 is fixed to the RP101 side or the FP102 side in advance, the fixing thereof is preferably made by a sealing material having a higher melting point than that of the sealing material 143 to be described hereinafter. For example, if the sealing material 143 to be described hereinafter is a low melting point metal such as indium or the like or the alloy thereof, the outer frame 103 is preferably fixed in advance to the RP101 or the FP102 by using a frit glass.

In (a) of FIG. 1, reference numeral 143 denotes a sealing material as described above and can be disposed in advance at the FP102 side end portion of the outer frame 103 arranged in the RP101 as a low melting point matter such as a frit glass or the like or the low melting point metal such as indium or the like or the alloy thereof. The arrangement of the sealing material 143 is not limited to this, but it may be arranged on a portion of the FP102 where the outer frame 103 is adhesively fixed. Moreover, when the outer frame 103 is introduced inside the main apparatus as a single independent component member, the sealing material 143 may be disposed on the RP101 side end portion and the FP102 end portion of the outer frame 103. Moreover, the sealing material 143 may be arranged in a portion on the RP101 and the FP102 where the end portion of the outer frame 103 is adhesively fixed. The portion where the above described sealing material 143 is disposed may be at least either of the end portion of the outer frame 103 or the portion on the RP101 and the FP102 where the end portion of this outer frame 103 is adhesively fixed.

In the apparatus as configured above, the step of vacuum-exhausting and sealing the panel will be shown as follows. Note that the following step is applied to the case where only one piece of the panel is sealed. When a plurality of panels are continuously processed and sealed, the processing time for each processing step is sometimes different. With respect to the step where the processing time is long, the processing step is divided into a plurality of processing chambers so that the long processing time is adjusted to other processing step time. Or a plurality of component elements, for example, hot plates or the like required for processing are arranged in the same processing chamber and the processing is simultaneously performed.

First, the outer frame 103 and the spacer 104 are fixed in advance and the sealing material 143 also carries the RP101 and the FP102 arranged in advance into the front chamber 105. Here, the outer frame 103 and the space 104 are fixed to the RP101 by using a frit glass, and indium is used as the sealing material 143. At the time of carrying, the above described RP101 and the FP102 are arranged on a carrying jig so that structurally a space is formed between both the substrates. Note that the carrying-in or the carrying-out is not limited to using the jig, but the substrates of the RP101, the FP102 as they are may be carried by a carrying support unit of the main apparatus side.

When the carrying-in is over, the gate valve 112 which is a carrying-in port is shut off and the inside of the front chamber 105 is vacuum-exhausted. During this time, the processing chambers on and after the bake processing chamber 106 are set at respective degrees of vacuum and temperature profiles. Hereinafter, at the time of carrying the substrates of the RP101 and the FP102, the gate valves 113 to 119 between the corresponding processing chambers are opened and shut off in order.

When the above described front chamber 105 reaches a vacuum exhausting state of $10^{-5}$ Pa level, the gate valve 113 is opened and the RP101 and the FP102 are carried out from the front chamber 105 to be moved to the bake processing chamber 106, and after the moving is over, the gate valve 113 is shut off.

The RP101 and the FP102 which were moved to the bake processing chamber without being exposed to the atmosphere are given heating treatment (bake processing) by the hot plates 121, 122 inside this bake processing chamber. By this bake processing, impurities such as hydrogen, oxygen, water or the like, which are contained in and adhered to PR101 and FP102, can be exhausted in a gas state. The bake temperature at this time is generally 300° C. to 400° C., preferably 350° C. to 380° C. The degree of vacuum at this time is about $10^{-4}$ Pa.

The RP101 and the FP102 where the bake processing was over is moved to the EB irradiating processing chamber 107, and the RP101 is fixed on the hot plate 123 and moved to the upper part of the EB irradiating processing chamber 107 by the lift 139. During this time, though the PR101 and the FP102 are separated temporarily from the hot plates 121, 122 of the bake processing chamber 106 which is a heating source, they are fixed to the hot plates 123, 124 of the EB irradiating processing chamber 107 in such a manner so as not to cause a sudden lowering of the temperature and heated to raise the temperature mildly. In this substrate temperature area of the rising temperature state, the EB irradiating processing is performed by emitting the EB 126 from the electron gun 125 to any area. The EB irradiating processing is generally performed within the range from 100° C. in the substrate temperature area to the bake temperature. The degree of vacuum at this time ranges from about $10^{-4}$ Pa to $10^{-5}$ Pa.

Here, it is preferable that the degree of vacuum state inside the surface cleaning processing chamber of the panel member such as the EB irradiating processing chamber 107 is set below $10^{-4}$ Pa, or more preferably below $10^{-5}$ Pa.

The EB irradiating processing is effective for substrate cleaning or the like by desorption of the gas from absorbed impurities through irradiation toward the RP101, the FP102. Moreover, as described above, at this time, the remaining heat in the bake processing step can be utilized in such a manner that the above described cleaning effect is improved much more. Note that the EB irradiation processing can be given to both the RP101, the FP102 or either one of them.

Moreover, the EB irradiation is not limited to the RP101, the FP102, but may be given to any area inside the EB irradiating step chamber. The EB irradiation processing is also effective in that, apart from the substrate cleaning, by performing the EB-irradiation inside the chamber space, it ionizes the gas desorbed by the baking and the EB irradiation substrate cleaning and expedites much more adhesion thereof to the getter in the getter flush processing in the later step.

Moreover, though the above described EB irradiating processing chamber 107, or this EB irradiating processing chamber 107 and a first getter processing chamber 108 (the chamber getter processing chamber) accomplish a function too as the cooling processing chamber for lowering the temperature of the RP101 and the FP102 which completed the bake processing, disposing another cooling processing chamber separately between the bake processing chamber 106 and the EB irradiating processing chamber 107 is one of the preferred embodiments.

In such a cooling processing chamber, the RP101 and the FP102 are fixed respectively to the hot plates so as not to cause a sudden lowering of the temperature from the heating temperature of the bake processing time, and the temperature is gradually lowered. The temperature range of the hot plates at this time is set in the range from 100° C. to the bake temperature so that the vacuum state inside the processing chamber is set below $10^{-4}$ Pa, or more preferably, below $10^{-5}$ Pa.

After the EB irradiating processing is over and the lift 139 is descended, the RP101 is taken out from the hot plate 123 and, together with the FP102, moved into the chamber getter processing chamber 108. At this time, the RP101 and the FP102 are moved into the chamber getter processing chamber 108 without being exposed to the atmosphere. The vacuum state inside the chamber getter processing chamber 108 is set in such a manner as to be below $10^{-5}$ Pa. In this chamber getter processing chamber, the evaporating getter member contained inside the chamber getter flush device 129 (for example, the getter member such as barium) is heated and evaporated by a method such as resistance heating or the like so as to generate the chamber getter flush 130, thereby allowing a getter film (not shown) comprising a barium film or the like adhere to the surface of the chamber getter board 131 arranged inside the chamber other than the panel member. The film thickness of the panel getter at this time is generally 5 nm to 500 nm, preferably 10 nm to 200 nm, more preferably 20 nm to 200 nm. By this chamber getter processing step, the getter film adhered to the chamber getter board 131 absorbs and exhausts the gas inside the chamber and the degree of vacuum inside the chamber getter processing chamber reaches a level of $10^{-6}$ Pa. The getter processing is performed with the substrate temperature of the RP101, the FP102 in the range from the bake temperature to 100° C. Note that the getter material evaporates by the chamber getter flush 130 and consequently the degree of vacuum inside the chamber is lowered temporarily, but by vacuum exhaust, it shifts to a high vacuum. Note also that the above described chamber getter processing is not limited to being performed by disposing the chamber getter processing chamber independently, but may be performed inside the panel getter processing chamber to be described hereinafter without disposing the chamber getter processing chamber particularly.

Next, the RP101 and the FP102 are moved into the panel getter processing chamber 109, and the RP101 is fixed to the hot plate 132 and moved to the upper part of the panel getter processing chamber 109 by the lift 141. The panel getter processing chamber 109 is vacuum-exhausted in advance to a level of $10^{-6}$ Pa. In order to reach this degree of vacuum, in addition to the usual vacuum exhaust pump, supplementary exhaust means such as the above described exhaust by the flush of the evaporating getter material, the exhaust by heating activation of non-evaporable getter material or the like can be also used. The above described method of vacuum exhausting to a level of $10^{-6}$ Pa can be also used for the sealing processing chamber 110 and the cooling processing chamber 111 to be described hereinafter.

In the panel getter processing chamber 109, the evaporating getter material (for example, the getter material such as barium) contained inside the panel getter flush device 134 is heated and evaporated by a method such as resistance heating or the like so as to generate the panel getter flush 135, thereby allowing a getter film (not shown) comprising a barium film or the like adhere to the surface of the FP. The film thickness of the panel getter at this time is generally 5 nm to 500 nm, preferably 10 nm to 200 nm, more preferably 20 nm to 200 nm. Here, the film-deposited evaporating getter scarcely suffers deterioration by gas absorption because the chamber in the processing step has a high vacuum of $10^{-6}$ Pa and is moved to the next sealing processing step while fully keeping a getter vacuum exhaust capacity.

In (a) of FIG. 1, though the getter film is adhered on the FP102 and formed there, the material to form is not limited to this, but it can be formed on the RP101 or the like also. However, because the getter material is generally conductive, there are cases where a large leak current is generated at the time when a sealed panel is driven to display an image, or a problem occurs such as an inability of maintaining the withstand pressure of a drive voltage. For example, when the panel getter flush is performed on the RP101 of (a) of FIG. 1, a conductive getter film is also formed on the outer frame 103 and the space 104. This sometimes causes an electrical problem at the time of driving. In such case, the part where the getter film is not to be adhered and formed is covered by a film-deposited mask of a thin metal so that no getter film is adhered and formed there and the necessary portion only of the RP101 can be getter-film-deposited. Note that the getter material evaporates by the panel getter flush and consequently the degree of vacuum inside the chamber is lowered temporarily, but by vacuum exhaust, it shifts to a high vacuum.

After the panel getter processing step is over, and after the lift 141 is descended, the RP101 is taken out from the hot plate 132 and, together with the FP102, moved to the sealing processing chamber 108.

The RP101, the FP102 are moved to the sealing processing chamber 110 which was vacuum-exhausted to a level of $10^{-6}$ Pa in advance, and the RP101, the FP102 are fixed respectively to the hot plates 136, 137. At this time, the sealing material 143 and the spacer 104 which are on the frame 103 arranged and fixed to the RP101 are not put in contact with the FP102, but fixed with a few space left in-between. Also at this fixing time, a relative position of the RP101 and the FP102 at the time of the panel sealing is determined. The determining of the relative position can be made based on the end standard by projecting pins, but is not limited to this.

After this, the lift 142 is descended and, by contacting and pressing the outer frame 103 which is arranged and fixed to the RP101 to the FP102, the temperature of the substrate is raised, as shown in the temperature profile of (b) of FIG. 1, to the sealing temperature suitable to the material of the sealing material 143. Then, the sealing material 143 is softened or melted and kept at a peak temperature for ten minutes. After this, the temperature of the substrate is raised so that the sealing material is adhesively fixed. By this, the sealing material 143 formed on the outer frame 103 is softened and melted so that the outer frame 103 and the FP102 are bonded. After this, the sealing material 143 is hardened and fixed. At this time, the degree of vacuum inside the sealing processing chamber 110 maintains $10^{-6}$ Pa and the degree of vacuum inside the panel sealed in the present step also becomes $10^{-6}$ Pa. The adhesively fixing temperature of the sealing material 143 was, for example, set to 160° C. as a heating peak temperature in case of indium metal and 140° C. as a hardening and fixing temperature. Also, when the sealing material 143 was a frit glass, the peak temperature was set to 390° C. and the hardening fixing temperature to 300° C. The raising rate of the temperature by heating is set to 20° C./min and the lowering rate to 5° C./min, but not limited to this. Also, the heating peak temperature and the hardening fixing temperature are not necessary limited to the above.

When the temperature is lowered below the hardening fixing temperature of the sealing material, the sealing processing is over and, after this, the RP101 is taken out from the hot plate 136 and the lift 142 is ascended. The FP102 is taken out from the hot plate 137 and a sealing panel 144 which is constituted of the RP101, the FP102, the outer frame 103 and the spacer 104 is moved to the cooling processing chamber 111. At this time, the cooling processing chamber 111 is vacuum-exhausted to a level of $10^{-6}$ Pa in order to maintain the degree of vacuum of the sealing processing chamber. The sealing panel 144 is taken out from the hot plate by the hardening fixing temperature of the sealing material and cooled in the cooling processing chamber 111. As for the cooling means, a cooling plate having a temperature control function by water-cooling or the like are used, but not limited to this. If a substrate damage due to a sudden lowering of the temperature of the sealing panel 144 does not occur, a natural cooling may be performed inside the cooling processing chamber 111.

At the stage where the temperature of the sealing panel 144 is lowered to a room temperature or a temperature close to the room temperature, a vacuum leak of the cooling processing chamber 111 is performed to allow the processing chamber to be at atmospheric pressure. After this, the gate valve 119 at the atmospheric side outside of the apparatus is opened and the sealing panel 144 is carried out of the apparatus.

The manufacturing apparatus of the present embodiment disposes the gate valve 118 between the above described sealing processing chamber 110 and the cooling chamber 111 and allows the display panel to be carried out from the sealing processing chamber 110 at the time of opening the gate valve so that it is carried into the cooling chamber 111 where, with the gate value shut off, it is cooled. After that, the carrying-out port 119 is opened, and the display panel is carried out from the cooling chamber 111 and, finally, with the carrying out port 119 shut off, all the steps complete. Before starting the next steps, the inside of the cooling chamber 111 may be preferably set to a vacuum state by a vacuum exhaust system (not shown) independently arranged.

In the present embodiment, in addition to the above described evaporating getter material, non-evaporable getter film or non-evaporable getter member comprising titanium material or the like may be disposed in advance on the RP101 or the FP102.

Moreover, the above described hot plates 121, 123, 127, 132 and 136 can use the equipment capable of fixing the FP101 by a full power without dropping it, for example, the equipment utilizing a chuck system by a claw for mechanically grasping a substrate periphery, an electrostatic chuck system or a vacuum absorption chuck system.

While the above described example is one example of the combination of the steps, the configuration example of the processing chamber can be enumerated by the combination of each processing step. That is, particularly, in the course from the bake processing to the sealing processing, as a first modified example, one example can be enumerated wherein, after the preparation under the vacuum atmosphere in the front chamber 105, each processing chamber is arranged in series so that the steps of: bake processing in the bake processing chamber 106; panel getter processing in the panel getter processing chamber 109; and heat sealing in the sealing processing chamber 110 are performed in order.

As a second modified example, one example can be enumerated, wherein after the preparation under the vacuum atmosphere in the front chamber 105, each processing chamber is arranged in series so that the steps of: bake processing in the bake processing chamber 106; surface cleaning processing such as the EB irradiating processing or the like in the EB irradiating processing chamber 107; panel getter processing in the panel getter processing chamber 109; and heat sealing in the sealing processing chamber 110 are performed in order.

As a third modified example, one example can be enumerated, wherein after the preparation under the vacuum atmosphere in the front chamber 105, each processing chamber is arranged in series so that the steps of: bake processing in the bake processing chamber 106; chamber getter processing in the chamber getter processing chamber 108; panel getter processing in the panel getter processing chamber 109; and heat sealing in the sealing processing chamber 110 are performed in order.

As a fourth modified example, one example can be enumerated, wherein after the preparation under the vacuum atmosphere in the front chamber 105, each processing chamber is arranged in series so that the steps of: surface cleaning processing such as the EB irradiating processing or the like in the EB irradiating processing chamber 107; chamber getter processing in the chamber getter processing chamber 108; panel getter processing in the panel getter processing chamber 109: heat sealing in the sealing processing chamber 110 are performed in order.

As a fifth modified example, one example can be enumerated, wherein after the preparation under the vacuum atmosphere in the front chamber 105, each processing chamber is arranged in series so that the steps of: bake processing in the bake processing chamber 106: cooling processing of the panel member in the cooling processing chamber panel getter processing in the panel getter processing chamber 109; and heat sealing in the sealing processing chamber 110 are performed in order.

As a sixth modified example, one example can be enumerated, wherein after the preparation under the vacuum atmosphere in the front chamber 105, each processing chamber is arranged in series so that the steps of: bake processing in the bake processing chamber 106; cooling processing of the panel member in the cooling processing chamber; surface cleaning processing such as the EB irradiating processing or the like in the EB irradiating processing chamber 107; panel getter processing in the panel getter processing chamber 109; and heat sealing in the sealing processing chamber 110 are performed in order.

As a seventh modified example, one example can be enumerated, wherein after the preparation under the vacuum atmosphere in the front chamber 105, each processing chamber is arranged in series so that the steps of: bake processing in the bake processing chamber 106; cooling processing of the panel member in the cooling processing chamber; chamber getter processing in the chamber getter processing chamber 108; panel getter processing in the panel getter processing chamber 109; and heat sealing in the sealing processing chamber 110 are performed in order.

As a eighth modified example, one example can be enumerated, wherein after the preparation under the vacuum atmosphere in the front chamber 105, each processing chamber is arranged in series so that the steps of: bake processing in the bake processing chamber 106; cooling processing of the panel member in the cooling processing chamber; surface cleaning processing such as the EB irradiating processing or the like in the EB irradiating processing chamber 107; chamber getter processing in the chamber getter processing chamber 108; panel getter processing in the panel getter processing chamber 109; and heat sealing in the sealing processing chamber 110 are performed in order.

Next, as for the modified examples of the carrying and introducing into the apparatus of the RP101, the FP102, the outer frame 103 and the space 104 which are the component members, as a first modified example, the RP101, the FP102 and the space 104 fixed and arranged on the outer frame 103 can be introduced inside the main apparatus as three pieces of the components members. In this case, the sealing surfaces of the outer frame 103 by the sealing processing inside the main apparatus are both side surfaces of the RP101, the FP102 and, therefore, it is necessary to form the sealing material in advance against the sealing surfaces.

As a second modified example, the RP101 and the outer frame 103 adhesively fixed to the FP102, or the outer frame 103 adhesively fixed to the RP101 and the FP102 and the spacer 104 can be introduced inside the main apparatus as two pieces of the component members. In this case, the sealing surface of the outer frame 103 by the sealing processing inside the main apparatus is the RP101 side and, therefore, it is necessary to form the sealing material in advance against the sealing surface.

Next, against the above described modified examples of the component members, from among the modified examples of the apparatus configuration wherein each processing chamber of the apparatus is arranged in one line for each component member and all the component members are merged into one processing chamber at the sealing processing step and the sealing processing is performed, as a first modified example, the apparatus configuration can be enumerated, wherein the RP101, the FP102 and the spacer 104 fixed and arranged on the outer frame 103 are taken as three pieces of the component members, while three lines of each processing chamber from the front chamber 105 to the panel getter flush processing chamber 109 are formed and the above described three pieces of the component members are introduced separately into each apparatus and the three panel getter processing chambers are connected so as to be merged into one sealing processing chamber, thereby performing the sealing processing of the three component members in the sealing processing chamber and performing the cooling processing as well.

As a second modified example, the apparatus configuration can be enumerated, wherein the FP102 and the outer frame 103 adhesively fixed and arranged on the RP101, or the outer frame 103 adhesively fixed and arranged on the FP102 and the RP101 and the spacer 104 are taken as two pieces of the component members, or the RP101 and the outer frame 103 adhesively fixed and arranged on the FP102 or the outer frame 103 adhesively fixed and arranged on the RP101 and the FP102 and the spacer 104 are taken as two pieces of the component members, while two lines of each processing chamber from the front chamber 105 to the panel getter processing chamber 109 are formed and the above described two pieces of the component members are introduced separately into each apparatus and the two panel getter processing chambers are connected so as to be merged into the sealing processing chamber, thereby performing the sealing processing of three pieces of the component members in the sealing processing chamber and performing the cooling processing as well. Note that the above described first and second modified examples include the case where the getter processing may be performed on any one piece of the three or two component members.

Moreover, according to the above described embodiment, while the degree of vacuum at the time of the panel sealing was set at a level of 106 pa, the present invention is not limited to this. That is, the degree of vacuum at the time of the panel sealing can be also set at a level of $10^{-5}$ Pa where even the usual vacuum pump can reach. In this case, the omission of the chamber getter processing chamber 140 and the getter processing step therein for raising the degree of vacuum inside the processing chamber is possible. The vacuum exhaust by a supplementary getter pump to reach $10^{-6}$ Pa can be also omitted.

The sealing panel 144 which performed the above processing step has structural characteristics in that, despite the fact that the evaporating getter material such as Ba or the like is film-formed on the FP, the getter ring for performing the getter flush by high frequency wave heating which is mainly an evaporating source of the evaporating getter material existing in the conventional sealing panel or the getter line for getter flushing mainly by resistance heating do not remain inside the sealing panel.

Moreover, the above processing steps and the apparatus are characterized in that they are constituted of the processing chambers from which the sealing step succeeding to the panel getter flush processing step is different.

Figure 2:
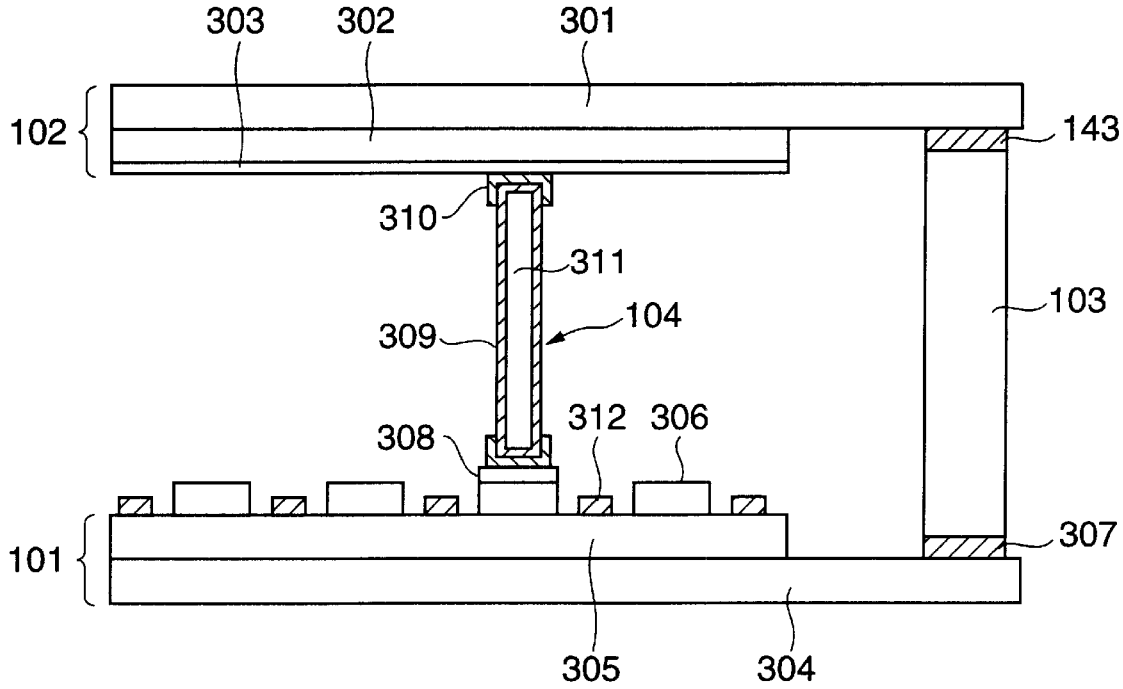
FIG. 2 is a sectional view partially showing an image displaying apparatus which is manufactured by the manufacturing apparatus and a manufacturing method according to the present invention.

FIG. 2 is a cross-sectional view showing a part of the image display apparatus prepared by using the manufacturing apparatus and the manufacturing method of the present embodiment.

In the drawings, the same reference numerals as FIG. 1 denote the same members. The image display apparatus prepared by the above described apparatus and method has a vacuum container or a pressure reducing container formed by the RP101, the FP102 and the outer frame 103. Inside the above pressure reducing container, inert gases or hydrogen gases such as argon gas, neon gas or the like can be contained under depressurized condition.

Moreover, in case of the vacuum container, the degree of vacuum can be set at more than $10^{-5}$ Pa, preferably more than $10^{-6}$ Pa.

Inside the above described vacuum container or the pressure reducing container, the spacer 104 is arranged so as to form an atmospheric proof structure. The spacer 104 used by the present invention has a main body 311 comprising: non alkali insulation substance such as non alkali glass or the like; a high resistance film 309 film-formed by a high resistance substance arranged by covering the surface of the main body 311; and metal (tungsten, copper, silver, gold, molybdenum or alloy thereof) films 308 and 310 disposed on both ends and is electrically connected and adhered on a wiring 306 through a conductive adhesive agent 308. The spacer 104 is, at the time of being carried into the above described front chamber 105, adhesively fixed to the PR101 in advance by the adhesive agent 308 and, at the time when the processing is over in the sealing processing chamber 110, the other end of the above described spacer 104 is electrically connected to the FP102 and contacts there and is arranged there.

In the RP101, a transparent substrate 304 such as a glass, a liner ($SiO_2$, $SnO_2$ or the like) 305 for preventing invasion of alkali such as sodium and a plurality of electron beam emitting elements 312 arrayed in XY matrix are arranged.

The present invention can use plasma generating elements in place of electron beam emitting elements used as the phosphor exciting means or the image display element members. At this time, inside the container, inert gasses or hydrogen gases such as argon gas, neon gas or the like are contained under depressurized condition.

In the FP102, the transparent substrate 301 such as a glass, a phosphor layer 302 and the anode metal (aluminum, silver, copper or the like) film 303 connected to an anode source (not shown) are arranged.

Moreover, the present invention can use a color filter in place of the phosphor used as the image display member when the above described plasma generating elements are used.

The outer frame 103 is adhesively fixed to the RP101 in advance by a low melting point adhesive agent 307 such as a frit glass and, at the processing step in the above described sealing processing chamber 110, is fixedly adhered by the sealing material 143 using indium and the frit glass.

According to the present invention, the above described electron emitting element and plasma generating element are disposed in the XY direction in a great number of such as more than one million picture elements and, when the image display apparatus disposed with a large screen of more than 30 inches in a diagonal size having a great number of picture elements is manufactured, a manufacturing step time was sharply shortened and the vacuum container constituting the image display apparatus was allowed to reach the degree of vacuum such as more than $10^{-6}$ Pa.

What is claimed is:

1. A manufacturing method of an image displaying apparatus comprising steps of conveying at least one panel member for composing a panel of the image displaying apparatus consecutively into a plurality of depressurized processing chambers equipped with temperature control means respectively, subjecting to a plurality of processings said at least one panel member while controlling temperature, and sealing plural panel members thereby forming the panel, wherein said plurality of processing chambers include a bake processing chamber for a bake processing of said at least one panel member and a getter processing chamber into which said at least one panel member is conveyed after said bake processing to subject to a getter processing said at least one panel member, and said getter processing is performed under a condition that said at least one panel member in said getter processing chamber is set at a temperature lower than a temperature of the panel member subjected to the bake processing in said bake processing chamber.

2. The manufacturing method of an image displaying apparatus according to claim 1, wherein said plurality of processing chambers include a preliminary chamber into which said at least one panel member is conveyed before conveyance into said getter processing chamber after the bake processing in said bake processing chamber and which is adjacent to said getter processing chamber, and an interior of said preliminary chamber and an interior of said getter processing chamber are set at pressures not higher than $10^{-4}$ Pa.

3. The manufacturing method of an image displaying apparatus according to claim 1, wherein the getter processing of an interior of said getter processing chamber is further performed in said getter processing chamber.

4. The manufacturing method of an image displaying apparatus according to claim 1, wherein said plural panel members are sealed with said at least one panel member set at a temperature higher than a temperature of said at least one panel member subjected to the getter processing in said getter processing chamber.

5. The manufacturing method of an image displaying apparatus according to claim 1, wherein said at least one panel member has a face plate to compose a display surface of said panel and is sealed to a rear plate which is disposed in opposition to said face plate with a gap interposed to compose a rear surface of said panel.

6. The manufacturing method of an image displaying apparatus according to claim 5, wherein a first sealing material is disposed on a side of said rear plate for sealing to said at least one panel member.

7. The manufacturing method of an image displaying apparatus according to claim 6, wherein said first sealing material is a metal having a low melting point or an alloy of said metal.

8. The manufacturing method of an image displaying apparatus according to claim 5, wherein an outer frame which is fixed with a second sealing material to compose a side surface of said panel and a first sealing material which is disposed on said outer frame to seal to said at least one panel member is disposed on a side of said rear plate.

9. The manufacturing method of an image displaying apparatus according to claim 8, wherein said second sealing material has a melting point higher than that of said first sealing material.

10. The manufacturing method of an image displaying apparatus according to claim 9, wherein said second sealing material is frit glass.

11. The manufacturing method of an image displaying apparatus according to claim 5, wherein said at least one panel member further have a first sealing material disposed on said face plate and is sealed to said rear plate with said first sealing material.

12. The manufacturing method of an image displaying apparatus according to claim 11, wherein said first sealing material is a metal having a low melting point or an alloy of said metal.

13. The manufacturing method of an image displaying apparatus according to claim 11, wherein an outer frame which is fixed with a second sealing material to compose a side surface of said panel is disposed on a side of said rear plate.

14. The manufacturing method of an image displaying apparatus according to claim 13, wherein said second sealing material has a melting point higher than that of said first sealing material.

15. The manufacturing method of an image displaying apparatus according to claim 13, wherein said second sealing material is frit glass.

16. The manufacturing method of an image displaying apparatus according to claim 5, wherein said at least one panel member further has an outer frame which is fixed to said face plate with a second sealing material to compose a side surface of said panel and are sealed to said rear plate.

17. The manufacturing method of an image displaying apparatus according to claim 16, wherein a first sealing material to be sealed to said at least one panel member is disposed on a side of said rear plate.

18. The manufacturing method of an image displaying apparatus according to claim 17, wherein said second sealing material has a melting point higher than that of said first sealing material.

19. The manufacturing method of an image displaying apparatus according to claim 18, wherein said first sealing material is a metal having a low melting point or an alloy of said metal.

20. The manufacturing method of an image displaying apparatus according to claim 18, wherein said second sealing material is frit glass.

21. The image displaying apparatus according to claim 5, wherein said at least one panel member further has an outer frame which is fixed to said face plate with a second sealing material to compose a side surface of said panel and a first sealing material disposed on said outer frame, and is sealed to said rear plate with said first, sealing material.

22. The manufacturing method of an image displaying apparatus according to claim 21, wherein said second sealing material has a melting point higher than that of said first sealing material.

23. The manufacturing method of an image displaying apparatus according to claim 21, wherein said first sealing material is a metal having a low melting point or an alloy of said metal.

24. The manufacturing method of an image displaying apparatus according to claim 21, wherein said second sealing material is frit glass.

25. The manufacturing method of an image displaying apparatus according to claim 5, wherein said rear plate has phosphor exciting means.

26. The manufacturing method of an image displaying apparatus according to claim 25, wherein said phosphor exciting means has an electron-emitting device.

27. The manufacturing method of an image displaying apparatus according to claim 5, wherein said face plate has a phosphor.

28. The manufacturing method of an image displaying apparatus according to claim 5, wherein said face plate has a phosphor and a metal back.

29. The manufacturing method of an image displaying apparatus according to claim 1, wherein said at least one panel member has a rear plate disposed in opposition to a face plate which is to compose a display surface of said panel so as to compose a rear surface of said panel and are sealed to said face plate.

30. The manufacturing method of an image displaying apparatus according to claim 29, wherein a first sealing material which is to be sealed to said at least one panel member is disposed on a side of said face plate.

31. The manufacturing method of an image displaying apparatus according to claim 30, wherein said first sealing material is a metal having a low melting point or an alloy of said metal.

32. The manufacturing method of an image displaying apparatus according to claim 29, wherein disposed on a side of said face plate is an outer frame which is fixed with a second sealing material to compose a side surface of said panel and a first sealing material which is disposed on said outer frame so as to be sealed to said at least one panel member.

33. The manufacturing method of an image displaying apparatus according to claim 32, wherein said second sealing material has a melting point higher than that of said first sealing material.

34. The manufacturing method of an image displaying apparatus according to claim 32, wherein said second sealing material is frit glass.

35. The manufacturing method of an image displaying apparatus according to claim 29, wherein said at least one panel member further has a first sealing material disposed on said rear plate and is sealed to said face plate with said first sealing material.

36. The manufacturing method of an image displaying apparatus according to claim 35, wherein said first sealing material is a metal having a low melting point or an alloy of said metal.

37. The manufacturing method of an image displaying apparatus according to claim 35, wherein an outer frame which is fixed with a second sealing material to compose a side surface of said panel is disposed on a side of said face plate.

38. The manufacturing method of an image displaying apparatus according to claim 37, wherein said second sealing material has a melting point higher than that of said first sealing material.

39. The manufacturing method of an image displaying apparatus according to claim 37, wherein said second sealing material is frit glass.

40. The image displaying apparatus according to claim 29, wherein said at least one panel member further has an outer frame which is fixed to said rear plate with a second sealing material to compose a side surface of said panel.

41. The manufacturing method of an image displaying apparatus according to claim 40, wherein said second sealing material is frit glass.

42. The manufacturing method of an image displaying apparatus according to claim 40, wherein a first sealing material which is to be sealed to said at least one panel member is disposed on a side of said face plate.

43. The manufacturing method of an image displaying apparatus according to claim 42, wherein said second sealing material has a melting point higher than that of said first sealing material.

44. The manufacturing method of an image displaying apparatus according to claim 42, wherein said first sealing material is a metal having a low melting point or an alloy of said metal.

45. The manufacturing method of an image displaying apparatus according to claim 29 wherein said at least one panel member further has an outer frame which is fixed to said rear plate with a second sealing material and a first sealing material which is disposed on said outer frame, and is sealed to said face plate with said first sealing material.

46. The manufacturing method of an image displaying apparatus according to claim 45, wherein said second sealing material has a melting point higher than that of said first sealing material.

47. The manufacturing method of an image displaying apparatus according to claim 45, wherein said first sealing material is a metal having a low melting point or an alloy of said metal.

48. The manufacturing method of an image displaying apparatus according to claim 45, wherein said second sealing material is frit glass.

49. A manufacturing method of an image displaying apparatus comprising steps of conveying at least one panel member for composing a panel of the image displaying apparatus consecutively into a plurality of depressurized processing chambers equipped with temperature control means respectively, subjecting to a plurality of processings said at least one panel member while controlling temperature, and forming the panel by sealing plural panel members, wherein said plurality of processing chambers include a bake processing chamber for bake processing of said at least one panel member, a surface clean processing chamber for surface clean processing of said at least one panel member into which said at least one panel member is conveyed after said bake processing and a getter processing chamber for getter processing of said at least one panel member into which said at least one panel member is conveyed after said surface clean processing, and said getter processing is performed with said at least one panel member in said getter processing chamber set at a temperature lower than a temperature of said at least one panel member subjected to the bake processing in said bake processing chamber.

50. The manufacturing method of an image displaying apparatus according to claim 49, wherein said plurality of processing chambers include a preliminary chamber into which said at least one panel member is conveyed before conveyance into said getter processing chamber after the surface clean processing in said surface clean processing chamber, and an interior of said preliminary chamber and an interior of said getter chamber are set at pressures not higher than $10^{-4}$ Pa.

51. The manufacturing method of an image displaying apparatus according to claim 49, wherein said surface clean chamber is adjacent to said getter processing chamber, and interiors of said surface clean processing chamber and said getter processing chamber are set at pressures not higher than $10^{-4}$ Pa.

52. The manufacturing method of an image displaying apparatus according to any one of claims 49 through 51, wherein said surface clean processing is a processing to irradiate a surface of said at least one panel member with an electron beam, thereby cleaning the surface of said member.

53. The manufacturing method of an image displaying apparatus according to any one of claims 49 through 51, wherein said surface clean processing is a processing to irradiate a surface of said at least one panel member with ions, thereby cleaning the surface of said member.

54. The manufacturing method of an image displaying apparatus according to any one of claims 49 through 51, wherein said surface clean processing is a processing to irradiate a surface of said at least one panel member with ultraviolet rays, thereby cleaning the surface of said member.

55. The manufacturing method of an image displaying apparatus according to any one of claims 49 through 51, wherein said surface clean processing is a processing to irradiate a surface of said at least one panel member with plasma, thereby cleaning the surface of said member.

56. A manufacturing method of an image displaying apparatus comprising steps of conveying at least one panel member for composing a panel of the image displaying apparatus consecutively into a plurality of depressurized processing chambers equipped with temperature control means respectively, subjecting to a plurality of processings said at least one panel member while controlling temperature, and forming the panel by sealing plural panel members, wherein said plurality of processing chambers include a bake processing chamber for bake processing of said at least one panel member, a first getter processing chamber into which said at least one panel member is conveyed after said bake processing and in which a getter processing is performed on an interior of said processing chamber, and a second getter processing chamber into which said at least one panel member is conveyed after the getter processing, in which the getter processing is performed on said at least one panel member and which is adjacent to said first getter processing chamber, and the getter processing of said at least one panel member is performed with said at least one panel member in said second getter processing chamber set at a temperature lower than a temperature of said at least one panel member subjected to the bake processing in said bake processing chamber.

57. The manufacturing method of an image displaying apparatus according to claim 56, wherein said plurality of processing chambers include a preliminary chamber into which said at least one panel member is conveyed before conveyance into said first getter processing chamber after the bake processing in said bake processing chamber and which is adjacent to said first getter processing chamber, and an interior of said preliminary chamber and interiors of said first and second getter processing chambers are set at pressures not higher than $10^{-4}$ Pa.

58. A manufacturing method of an image displaying apparatus comprising steps of conveying at least one panel member for composing a panel of the image displaying apparatus consecutively into a plurality of depressurized chambers equipped with temperature control means respectively, subjecting to a plurality of processings said at least one panel member while controlling temperatures and forming the panel by sealing plural panel members, wherein said plurality of processing chambers include a bake processing chamber for bake processing of said at least one panel member, a surface clean processing chamber for surface clean processing of said at least one panel member into which said at least one panel member is conveyed after said bake processing, a first getter processing chamber into which said at least one panel member is conveyed after said surface clean processing for a getter processing of said processing chamber and a second getter processing chamber into which said at least one panel member is conveyed after said getter processing for the getter processing of said at least one panel member and which is adjacent to said first getter processing chamber, and the getter processing of said at least one panel member is performed with said at least one panel member in said second getter processing chamber set at a temperature lower than a temperature of said at least one panel member subjected to the bake processing in said bake processing chamber.

59. The manufacturing method of an image displaying apparatus according to any one of claims 56 through 60, wherein said plural panel members are sealed with said at least one panel member set at a temperature higher than a temperature of the at least one panel member subjected to the getter processing in said second getter processing chamber.

60. The manufacturing method of an image displaying apparatus according to claim 58, wherein said surface clean processing chamber is adjacent to said first getter processing chamber, and interiors of said surface clean processing chamber and said first and second getter processing chambers are set at pressures not higher than $10^{-4}$ Pa.

61. The manufacturing method of an image displaying apparatus according to claim 58 or 60, wherein said surface clean processing is a processing to irradiate a surface of said at least one panel member with an electron beam, thereby cleaning the surface of said member.

62. The manufacturing method of an image displaying apparatus according to claim 58 or 60, wherein said surface clean processing is a processing to irradiate a surface of said at least one panel member with ions, thereby cleaning the surface of said member.

63. The manufacturing method of an image displaying apparatus according to claim 58 or 60, wherein said surface clean processing is a processing to irradiate a surface of said at least one panel member with ultraviolet rays, thereby cleaning the surface of said member.

64. The manufacturing method of an image displaying apparatus according to claim 58 or 60, wherein said surface clean processing is a processing to irradiate a surface of said at least one panel member with plasma, thereby cleaning the surface of said member.

65. A manufacturing method of an image displaying apparatus comprising steps of conveying at least one panel member for composing a panel of the image displaying apparatus consecutively into a plurality of depressurized processing chambers equipped with temperature control means respectively, subjecting to a plurality of processings said at least one panel member while controlling temperature and forming the panel by sealing plural panel members, wherein said plurality of processing chambers include a bake processing chamber for bake processing of said at least one panel member, a cool processing chamber into which said at least one panel member is conveyed after said bake processing for cool processing to cool said at least one panel member and a getter processing chamber into which said at least one panel member is conveyed after said cool processing for a getter processing of said at least one panel member.

66. The manufacturing method of an image displaying apparatus according to claim 65, wherein said plurality of processing chambers include a preliminary chamber into which said at least one panel member is conveyed before conveyance into said getter after the cool processing in said cool processing chamber and which is adjacent to said getter processing chamber, and an interior of said preliminary chamber and an interior of said getter processing chamber are set at pressures not higher than $10^{-4}$ Pa.

67. The manufacturing method of an image displaying apparatus according to claim 65, wherein said cool processing chamber is adjacent to said getter processing chamber, and interiors of said cool processing chamber and said getter processing chamber are set at pressures not higher than $10^{-4}$ Pa.

68. The manufacturing method of an image displaying apparatus according to any one of claims 65 through 67, wherein the getter processing of an interior of the getter processing chamber is further performed in said getter processing chamber.

69. The manufacturing method of an image displaying apparatus according to any one of claims 65 through 67, wherein the getter processing of the interior of said cool processing chamber is further performed in said cool processing chamber.

70. The manufacturing method of an image displaying apparatus according to any one of claims 65 through 67, wherein a surface clean processing of said at least one panel member is further performed in said cool processing chamber.

71. The manufacturing method of an image displaying apparatus according to claim 70, wherein the getter processing of the interior of the cool processing chamber is further performed in said cool processing chamber.

72. The manufacturing method of an image displaying apparatus according to claim 70, wherein said surface clean processing is a processing to irradiate a surface of said at least one panel member with an electron beam, thereby cleaning the surface of said member.

73. The manufacturing method of an image displaying apparatus according to claim 70, wherein said surface clean processing is a processing to irradiate a surface of said at least one panel member with ions, thereby cleaning the surface of said member.

74. The manufacturing method of an image displaying apparatus according to claim 70, wherein said surface clean processing is a processing to irradiate a surface of said at least one panel member with ultraviolet rays, thereby cleaning the surface of said member.

75. The manufacturing method of an image displaying apparatus according to claim 70, wherein said surface clean processing is a processing to irradiate a surface of said at least one panel member with plasma, thereby cleaning the surface of said member.

76. The manufacturing method of an image displaying apparatus according to claim 65, wherein sealing of said plural panel members is performed with said at least one panel member set at a temperature higher than a temperature of said at least one panel member subjected to the getter processing in said getter processing chamber.

77. A manufacturing method of an image displaying apparatus comprising steps of conveying at least one panel member for composing a panel of the image displaying apparatus consecutively into a plurality of depressurized processing chambers equipped with temperature control means respectively, subjecting to a plurality of processings of said at least one panel member while controlling temperature and forming the panel by sealing plural panel members, wherein said plurality of processing chambers include a bake processing chamber for a bake processing of said at least one panel member, a cool processing chamber for cooling said at least one panel member into which said at least one panel member is conveyed after said bake processing, a surface clean processing chamber for a surface clean processing of said at least one panel member into which said at least one panel member is conveyed after said cool processing and a getter processing chamber for a getter processing of said at least one panel member into which said at least one panel member is conveyed after said surface clean processing.

78. The manufacturing method of an image displaying apparatus according to claim 77, wherein said plurality of processing chambers include a preliminary chamber into which said at least one panel member is conveyed before conveyance into said getter processing chamber after the surface clean processing in said surface clean processing chamber and which is adjacent to said getter processing chamber, and an interior of said preliminary chamber and an interior of said getter processing chamber are set at $10^{-4}$ Pa or more depressurized level.

79. The manufacturing method of an image displaying apparatus according to claim 77, wherein said surface clean processing chamber is adjacent to said getter processing chamber, and interiors of said surface clean processing chamber and said getter processing chamber are set at $10^{-4}$ Pa or more depressurized level.

80. The manufacturing method of an image displaying apparatus according to any one of claims 77 through 79, wherein the getter processing of the interior of the getter processing chamber is further performed in sad getter processing chamber.

81. The manufacturing method of an image displaying apparatus according to any one of claims 77 through 79, wherein said surface clean processing is a processing to irradiate a surface of said at least one panel member with an electron beam, thereby cleaning the surface of said member.

82. The manufacturing method of an image displaying apparatus according to any one of claims 77 through 79, wherein said surface clean processing is a processing to irradiate a surface of said at least one panel member with ions, thereby cleaning the surface of said member

83. The manufacturing method of an image displaying apparatus according to any one of claims 77 through 79, wherein said surface clean processing is a processing to irradiate a surface of said at least one panel member with ultraviolet rays, thereby cleaning the surface of said member.

84. The manufacturing method of an image displaying apparatus according to any one of claims 77 through 79, wherein said surface clean processing is a processing to irradiate a surface of said at least one panel member with plasma, thereby cleaning the surface of said member.

85. A manufacturing method of an image displaying apparatus comprising steps of conveying at least one panel member for composing a panel of the image displaying apparatus consecutively into a plurality of depressurized chambers equipped with temperature control means respectively, subjecting to a plurality of processings said at least one panel member while controlling temperatures and forming the panel by sealing said plural panel members, wherein said plurality of processing chambers comprise:

a bake processing chamber for a bake processing of said at least one panel member;

a cool processing chamber for cooling said at least one panel member into which said at least one panel member is conveyed after said bake processing;

a first getter processing chamber for a getter processing of an interior of said getter processing chamber into which said at least one panel member is conveyed after said cool processing; and a second getter processing chamber for the getter processing of said at least one panel member into which said at least one panel member is conveyed after said getter processing and which is adjacent to said first getter processing chamber.

86. The manufacturing method of an image displaying apparatus according to claim 85, wherein said cool processing chamber is adjacent to said first getter processing chamber, and interiors of said cool processing chamber and said first and second getter processing chambers are set at $10^{-4}$ Pa or more depressurized level.

87. The manufacturing method of an image displaying apparatus according to claim 85 or 86, wherein a surface clean processing of said at least one panel member is further performed in said cool processing chamber.

88. The manufacturing method of an image displaying apparatus according to claim 87, wherein said surface clean processing is a processing to irradiate a surface of said at least one panel member with an electron beam, thereby cleaning the surface of said member.

89. The manufacturing method of an image displaying apparatus according to claim 87, wherein said surface clean processing is a processing to irradiate a surface of said at least one panel member with ions, thereby cleaning the surface of said member.

90. The manufacturing method of an image displaying apparatus according to claim 87, wherein said surface clean processing is a processing to irradiate a surface of said at least one panel member with ultraviolet rays, thereby cleaning the surface of said member.

91. The manufacturing method of an image displaying apparatus according to claim 87, wherein said surface clean processing is a processing to irradiate a surface of said at least one panel member with plasma, thereby cleaning the surface of said member.

92. A manufacturing method of an image displaying apparatus comprising steps of conveying at least one panel member for composing a panel of the image displaying apparatus consecutively into a plurality of depressurized processing chambers equipped with temperature control means respectively, subjecting to a plurality of processings said at least one panel member while controlling temperature and forming the panel by sealing plural panel members, wherein said plurality of processing chamber include:

a bake processing chamber for a bake processing of said at least one panel member;

a cool processing chamber for cooling said at least one panel member into which said at least one panel member is conveyed after said bake processing;

a surface clean processing chamber for a surface clean processing of said at least one panel member into which said at least one panel member is conveyed after said cool processing;

a first getter processing chamber for a getter processing of an interior of said processing chamber into which said at least one panel member is conveyed after said surface clean processing; and a second getter processing chamber adjacent to said first getter processing chamber for the getter processing of said at least one panel member into which said at least one panel member is conveyed after said getter processing.

93. The manufacturing method of an image displaying apparatus according to claim 85 or 92, wherein sealing of said plural panel members is performed with said at least one panel member set at a temperature higher than a temperature of the at least one panel member subjected to the getter processing in said second getter processing chamber.

94. The manufacturing method of an image displaying apparatus according to claim 92, wherein said surface clean processing chamber is adjacent to said first getter processing chamber, and interiors of said surface clean processing chamber and said first and second getter processing chambers are set at $10^{-4}$ Pa or more depressurized level.

95. The manufacturing method of an image displaying apparatus according to claim 92 or 94, wherein said surface clean processing is a processing to irradiate a surface of said at least one panel member with an electron beam, thereby cleaning the surface of said member.

96. The manufacturing method of an image displaying apparatus according to claim 92 or 94, wherein said surface clean processing is a processing to irradiate a surface of said at least one panel member with ions, thereby cleaning the surface of said member.

97. The manufacturing method of an image displaying apparatus according to claim 92 or 94, wherein said surface clean processing is a processing to irradiate a surface of said at least one panel member with ultraviolet rays, thereby cleaning the surface of said member.

98. The manufacturing method of an image displaying apparatus according to claim 92 or 94, wherein said surface clean processing is a processing to irradiate a surface of said at least one panel member with plasma, thereby cleaning the surface of said member.

99. A manufacturing method of an image displaying apparatus, comprising the steps of:

a: conveying a first member including a substrate on which phosphor exciting means is disposed and a second member including a substrate on which a phosphor is disposed into a bake processing chamber filled with a depressurized atmosphere, and heating for a bake processing;

b: conveying either or both of said first member and said second member through a depressurized atmosphere into a cool processing chamber filled with the depressurized atmosphere for cooling;

c: conveying either or both of said first member and said second member through a depressurized atmosphere into a getter processing chamber filled with the depressurized atmosphere for a getter processing of said member or either or both of said members; and d: conveying said first member and said second member through a depressurized atmosphere into a seal processing chamber filled with the depressurized atmosphere.

100. The manufacturing method of an image displaying apparatus according to claim 99, wherein a surface clean processing of said member or either or both of said members is performed in the cool processing chamber, and the getter processing of an interior of said cool processing chamber is performed at said step b.

101. The manufacturing method of an image displaying apparatus according to claim 99, wherein the getter processing is performed at said step c while heating said member or either or both of said members and a heating temperature at said step c is lower than a heating temperature at said step a.

102. The manufacturing method of an image displaying apparatus according to claim 99, wherein a surface clean processing of said member or either or both of said members is performed in the cool processing chamber at said step b.

103. The manufacturing method of an image displaying apparatus according to claim 102, wherein said surface clean processing is a processing to irradiate a surface of said member with an electron beam, thereby cleaning the surface of said member.

104. The manufacturing method of an image displaying apparatus according to claim 102, wherein said surface clean processing is a processing to irradiate a surface of said member with ions, thereby cleaning the surface of said member.

105. The manufacturing method of an image displaying apparatus according to claim 102, wherein said surface clean processing is a processing to irradiate a surface of said member with ultraviolet rays, thereby cleaning the surface of said member.

106. The manufacturing method of an image displaying apparatus according to claim 102, wherein said surface clean processing is a processing to irradiate a surface of said member with plasma, thereby cleaning the surface of said member.

107. A manufacturing method of an image displaying apparatus, comprising the steps of:

a: conveying a first member including a substrate on which phosphor exciting means is disposed and a second member including a substrate on which a phosphor is disposed into a bake processing chamber filled with a depressurized atmosphere and heating for a bake processing;

b: conveying either or both of said first member and said second member through a depressurized atmosphere into a surface clean processing chamber filled with the depressurized atmosphere and performing a surface clean processing of said member or either or both of said members;

c: conveying either or both of said first member and said second member through a depressurized atmosphere into a getter processing chamber filled with the depressurized atmosphere, and performing a getter processing of said member or either or both of said members; and d: conveying said first member and said second member through a depressurized atmosphere into a seal processing chamber filled with the depressurized atmosphere and heating for sealing.

108. The manufacturing method of an image displaying apparatus according to claim 107, wherein the getter processing of an interior of the surface clean processing chamber is performed in the surface clean processing chamber at said step b.

109. The manufacturing method of an image displaying apparatus according to claim 107 or 108, wherein said member or either or both of said members are cooled in the surface clean processing chamber at said step b.

110. A manufacturing method of an image displaying apparatus, comprising the steps of:

a: conveying a first member including a substrate on which phosphor exciting means is disposed and a second member including a substrate on which a phosphor is disposed into a bake processing chamber filled with a depressurized chamber and heating for a bake processing;

b: conveying either or both of said first member and said second member through a depressurized atmosphere into a surface clean processing chamber filled with the depressurized atmosphere and performing a surface clean processing of said member or either or both of said members;

c: conveying either or both of said first member and said second member through a depressurized atmosphere into a first getter processing chamber filled with the depressurized atmosphere and performing a getter processing of an interior of said first getter processing chamber;

d: conveying either or both of said first member and said second member through a depressurized atmosphere into a second getter processing chamber filled with the depressurized atmosphere and performing the getter processing of said member or either or both of the said members; and e: conveying said first member and said second member through a depressurized atmosphere into a seal processing chamber filled with the depressurized atmosphere and heating for sealing.

111. The manufacturing method of an image displaying apparatus according to claim 110, wherein said member or either or both of said members are cooled in the surface clean processing chamber at said step b.

112. A manufacturing method of an image displaying apparatus, comprising the steps of:

a: conveying a first member including a substrate on which phosphor exciting means is disposed and a second member including a substrate on which a phosphor is disposed into a bake processing chamber filled with a depressurized atmosphere and heating for a bake processing;

b: conveying either or both of said first member and said second member through a depressurized atmosphere into a cool processing chamber filled with the depressurized atmosphere and performing a cool processing;

c: conveying either or both of said first member and said second member through a depressurized atmosphere into a surface clean processing chamber filled with the depressurized atmosphere, and performing a surface clean processing of said member or either or both of said members;

d: conveying either or both of said first member and said second member through a depressurized atmosphere into a getter processing chamber filled with the depressurized atmosphere and performing a getter processing of said member or either or both of said members; and e: conveying said first member and said second member through a depressurized atmosphere into a seal processing chamber filled with the depressurized atmosphere and heating for sealing.

113. The manufacturing method of an image displaying apparatus according to any one of claims 110 through 112, wherein the getter processing is performed at said step d while heating said member or either or both of said members and a heating temperature at said step d is lower than a heating temperature at said step a.

114. A manufacturing method of an image displaying apparatus, comprising the steps of:

a: conveying a first member including a substrate on which phosphor exciting means is disposed and a second member including a substrate on which a phosphor is disposed, and heating for a bake processing;

b: conveying either or both of said first member and said second member through a depressurized atmosphere into a cool processing chamber filled with the depressurized atmosphere, and performing a cool processing;

c: conveying either or both of said first member and said second member through a depressurized atmosphere into a surface clean processing chamber filled with the depressurized atmosphere, and performing a surface clean processing of said member or either or both of said members;

d: conveying either or both of said first member and said second member through a depressurized atmosphere into a first getter processing chamber filled with the depressurized atmosphere, and performing a getter processing of an interior of said first getter processing chamber;

e: conveying either or both of said first member and said second member through a depressurized atmosphere into a second getter processing chamber filled with the depressurized atmosphere, and performing the getter processing of said member or either or both of said members; and f: conveying said first member and said second member through a depressurized atmosphere into a seal processing chamber filled with the depressurized atmosphere.

115. The manufacturing method of an image displaying apparatus according to claim 114, wherein the getter processing at said step a is performed while heating said member or either or both of said members and a heating temperature at step a is lower than a heating temperature at said step a.

116. A manufacturing method of an image displaying apparatus comprising steps of:

a: conveying a first member including a substrate on which phosphor exciting means is disposed and a second member including a substrate on which a phosphor is disposed into a bake processing chamber filled with a depressurized atmosphere and heating for a bake processing;

b: conveying either or both of said first member and said second member through a depressurized atmosphere into a getter processing chamber filled with the depressurized atmosphere and performing a getter processing of said member or either or both of said members; and c: conveying said first member and said second member through a depressurized atmosphere into a seal processing chamber filled with the depressurized atmosphere, and heating for sealing, wherein a temperature of a member subjected to the getter processing at said step b is lower than a heating temperature at said step a.

117. The manufacturing method of an image displaying apparatus according to claim 116, wherein the getter processing at said step b is performed while heating said member or either or both of said members and a heating temperature at the step b is lower than a heating temperature at said step a.

118. The manufacturing method of an image displaying apparatus according to any one of claims 116, 99, 107, 110, 112 and 114, wherein said first member has a substrate on which phosphor exciting means is disposed and an outer frame.

119. The manufacturing method of an image displaying apparatus according to any one of claims 116, 99, 107, 110, 112 and 114, wherein said first member has a substrate on which phosphor exciting means is disposed and a spacer.

120. The manufacturing method of an image displaying apparatus according to any one of claims 116, 99, 107, 110, 112 and 114, wherein said first member has a substrate on which phosphor exciting means is disposed, an outer frame and a spacer.

121. The manufacturing method of an image displaying apparatus according to any one of claims 116, 99, 107, 110, 112 and 114, wherein said second member has a substrate on which phosphor is disposed and an outer frame.

122. The manufacturing method of an image displaying apparatus according to any one of claims 116, 99, 107, 110, 112 and 114, wherein said second member has a substrate on which phosphor is disposed and a spacer.

123. The manufacturing method of an image displaying apparatus according to any one of claims 116, 99, 107, 110, 112 and 114, wherein said second member has a substrate on which a phosphor is disposed, an outer frame and a spacer.

124. The manufacturing method of an image displaying apparatus according to any one of claims 116, 99, 107, 110, 112 and 114, wherein a getter used for said getter processing is an evaporating getter.

125. The manufacturing method of an image displaying apparatus according to any one of claims 116, 99, 107, 110, 112 and 114, wherein said phosphor exciting means has an electron-emitting device.

126. A manufacturing method of an image displaying apparatus comprising a panel composed of panel members comprising a step of:

conveying at least one panel member consecutively into a plurality of depressurized processing chambers equipped with temperature controlling means respectively, for subjecting to a plurality of processings said panel member while controlling temperature, wherein said plurality of processing chambers include a bake processing chamber for a bake processing of said panel member and a getter processing chamber into which said panel member is conveyed after said bake processing to subject to a getter processing said panel member, and said getter processing is performed under a condition that said panel member in said getter processing chamber is set at a temperature lower than a temperature of said panel member subjected to the bake processing in said bake processing chamber.

127. The manufacturing method of an image displaying apparatus according to claim 126, wherein said panel member is seal bonded to another panel member thereby forming said panel.

* * * * *

UNITED STATES PATENT AND TRADEMARK OFFICE

CERTIFICATE OF CORRECTION

PATENT NO. : 6,634,916 B2
DATED : October 21, 2003
INVENTOR(S) : Tetsuya Kaneko et al.

It is certified that error appears in the above-identified patent and that said Letters Patent is hereby corrected as shown below:

Title page,
Item [57], ABSTRACT,
Line 4, “processng” should read -- processing --.

Column 1,
Line 51, “vol, 26” should read -- vol. 26 --.

Column 2,
Line 3, “to manu-” should read -- for manu- --;
Line 4, “of a” should read -- a --; and
Line 12, “two a” should read -- two, a --.

Column 3,
Line 17, “a depressurized” should read -- depressurized --.

Column 5,
Line 25, “provide” should read -- provides --; and
Line 42, “that:” should read -- that --.

Column 7,
Line 65, “the a” should read -- the --.

Column 8,
Line 25, “and a heat” should read -- and heat --; and
Line 26, “pair” should read -- pairs --.

Column 9,
Line 47, “processing” should read -- processing chambers --.

Column 10,
Line 60, “camber” should read -- chamber --.

Column 13,
Line 45, “descried” should read -- described --.

Column 14,
Line 21, “descried” should read -- described --.

UNITED STATES PATENT AND TRADEMARK OFFICE

CERTIFICATE OF CORRECTION

PATENT NO. : 6,634,916 B2
DATED : October 21, 2003
INVENTOR(S) : Tetsuya Kaneko et al.

It is certified that error appears in the above-identified patent and that said Letters Patent is hereby corrected as shown below:

Column 16,
Line 1, “an low” should read -- a low --; and
Line 44, “of above” should read -- of the above --.

Column 18,
Line 51, “in an” should read -- in a --.

Column 19,
Line 21, “an display” should read -- a display --; and
Line 23, “of the” should read -- the --.

Column 22,
Line 16, “described member” should read --described first member --.

Column 23,
Line 4, “excising” should read -- exciting --;
Line 26, “bake processed” should read -- bake-processed --; and
Line 55, “raise” should read -- rise --.

Column 25,
Line 13, “inside” should read -- inside the --; and
Line 48, “receive” should read -- receives --.

Column 26,
Line 13, “vale” should read -- valve --.

Column 28,
Line 65, “like” should read -- like to --.

Column 30,
Line 57, “like are” should read -- like is --.

Column 31,
Line 8, “value” should read -- valve --.

Column 32,
Line 5, “106:” should read -- 106; --; and
Line 31, “a eighth” should read -- an eighth --.

UNITED STATES PATENT AND TRADEMARK OFFICE

CERTIFICATE OF CORRECTION

PATENT NO. : 6,634,916 B2
DATED : October 21, 2003
INVENTOR(S) : Tetsuya Kaneko et al.

It is certified that error appears in the above-identified patent and that said Letters Patent is hereby corrected as shown below:

Column 33,
Line 42, "106 pa," should read -- $10^{-6}$ Pa., --.

Column 34,
Line 21, "and is" should read -- and are --.

Column 35,
Line 54, "to said" should read -- said --.

Column 40,
Line 7, "56 through 60" should read -- 56 through 58, and 60 --.

Column 42,
Line 24, "sad" should read -- said --.

Column 43,
Line 40, "chamber" should read -- chambers --.

Column 46,
Line 5, "of the said" should read -- of said --.

Column 47,
Line 17, "step a" should read -- step e --; and
Line 46, "at the step" should read -- at said step --.

Signed and Sealed this

Twenty-eighth Day of September, 2004

JON W. DUDAS
*Director of the United States Patent and Trademark Office*